US011988409B2

(12) United States Patent
Chothave et al.

(10) Patent No.: US 11,988,409 B2
(45) Date of Patent: May 21, 2024

(54) PARTITION WALL FOR AN HVAC DEVICE

(71) Applicant: Johnson Controls Tyco IP Holdings LLP., Milwaukee, WI (US)

(72) Inventors: Amit R. Chothave, Nashik (IN); Piyush R. Adhav, Ahmednagar (IN); Sriram Ramanujam, Chennai (IN); Karan Garg, Pune (IN)

(73) Assignee: Tyco Fire & Security GmbH, Neuhausen am Rheinfall (CH)

( * ) Notice: Subject to any disclaimer, the term of this patent is extended or adjusted under 35 U.S.C. 154(b) by 0 days.

(21) Appl. No.: 17/544,732

(22) Filed: Dec. 7, 2021

(65) Prior Publication Data

US 2022/0178563 A1 Jun. 9, 2022

(51) Int. Cl.
*F24F 7/04* (2006.01)
*F24F 13/20* (2006.01)

(52) U.S. Cl.
CPC ..... *F24F 7/04* (2013.01); *F24F 13/20* (2013.01)

(58) Field of Classification Search
CPC ... F16B 5/044; F24F 13/20; F24F 1/02; F24F 1/022
See application file for complete search history.

(56) References Cited

U.S. PATENT DOCUMENTS 4,915,537 A * 4/1990 Bergheim ..... F16B 5/0044 403/248
2011/0126487 A1* 6/2011 Browning ..... E04B 1/14 52/586.1
2015/0111487 A1* 4/2015 Son ..... F24F 3/044 454/329
2018/0094429 A1* 4/2018 Mislak ..... B32B 7/12
2021/0325081 A1* 10/2021 Kagawa ..... F24F 1/16

FOREIGN PATENT DOCUMENTS

KR 20060081732 A * 7/2006

* cited by examiner

*Primary Examiner* — Vivek K Shirsat
*Assistant Examiner* — Michael James Giordano
(74) *Attorney, Agent, or Firm* — Fletcher Yoder, PC

(57) ABSTRACT

A partition wall for a heating, ventilation, and air conditioning (HVAC) system includes a frame defining a perimeter of the partition wall, and one or more panels extending within the frame. Each of the one or more panels comprises a flange configured to abut another of the one or more panels or the frame to provide a substantially air-tight engagement there between.

20 Claims, 15 Drawing Sheets

PARTITION WALL FOR AN HVAC DEVICE

CROSS REFERENCE TO RELATED APPLICATION

This application claims priority from and the benefit of India Provisional Application Serial No. 202011053202, entitled "PARTITION WALL FOR AN HVAC DEVICE," filed Dec. 7, 2020, which is hereby incorporated by reference in its entirety for all purposes.

BACKGROUND

This section is intended to introduce the reader to various aspects of art that may be related to various aspects of the present disclosure that are described below. This discussion is believed to be helpful in providing the reader with background information to facilitate a better understanding of the various aspects of the present disclosure. Accordingly, it should be noted that these statements are to be read in this light, and not as admissions of prior art.

Heating, ventilation, and air conditioning (HVAC) systems are utilized to control environmental properties, such as temperature and humidity, for occupants of residential, commercial, and industrial environments. The HVAC systems may control the environmental properties through control of an air flow delivered to the environment. For example, an HVAC system may include several heat exchangers, such as a heat exchanger configured to place an air flow in a heat exchange relationship with a refrigerant of a vapor compression circuit (e.g., evaporator, condenser), a heat exchanger configured to place an air flow in a heat exchange relationship with combustion products (e.g., a furnace), or both. In some embodiments, the HVAC system may include a housing configured to enclose various components of the HVAC system (e.g., heat exchangers, blowers, fans), and the housing may include one or more partition walls defining one or more compartments within the HVAC system.

SUMMARY

A summary of certain embodiments disclosed herein is set forth below. It should be noted that these aspects are presented merely to provide the reader with a brief summary of these certain embodiments and that these aspects are not intended to limit the scope of this disclosure. Indeed, this disclosure may encompass a variety of aspects that may not be set forth below.

In an embodiment, a partition wall for a heating, ventilation, and air conditioning (HVAC) system includes a frame defining a perimeter of the partition wall, and one or more panels extending within the frame. Each of the one or more panels comprises a flange configured to abut another of the one or more panels or the frame to provide a substantially air-tight engagement there between.

In another embodiment, a heating, ventilation, and air conditioning (HVAC) unit comprises a housing configured to provide support for one or more components of the HVAC unit and one or more partition walls extending within or around the housing and configured to separate the housing into two or more internal volumes. A partition wall of the one or more partition walls comprises a frame coupled to the housing and defining a perimeter of the partition wall, and one or more panels extending within the frame. The frame comprises a first support member, a second support member, a first cross rail, and a second cross rail, and each of the one or more panels comprises a flange configured to abut another of the one or more panels or the frame to provide substantially air-tight engagement there between.

In another embodiment, a housing configured to enclose one or more components of a heating, ventilation, and air conditioning (HVAC) system comprises a base and one or more frames coupled to the base and configured to define a perimeter of one or more partition walls extending within the housing. The one or more partition walls is configured to separate the housing into two or more internal volumes, and each of the one or more partition walls comprises one or more panels extending within a frame of the one or more frames. Each of the one or more panels comprises one or more flanges configured to abut another of the one or more panels or the frame to provide substantially air-tight engagement there between.

BRIEF DESCRIPTION OF THE DRAWINGS

Various aspects of this disclosure may be better understood upon reading the following detailed description and upon reference to the drawings in which.

DETAILED DESCRIPTION

Figure 1:
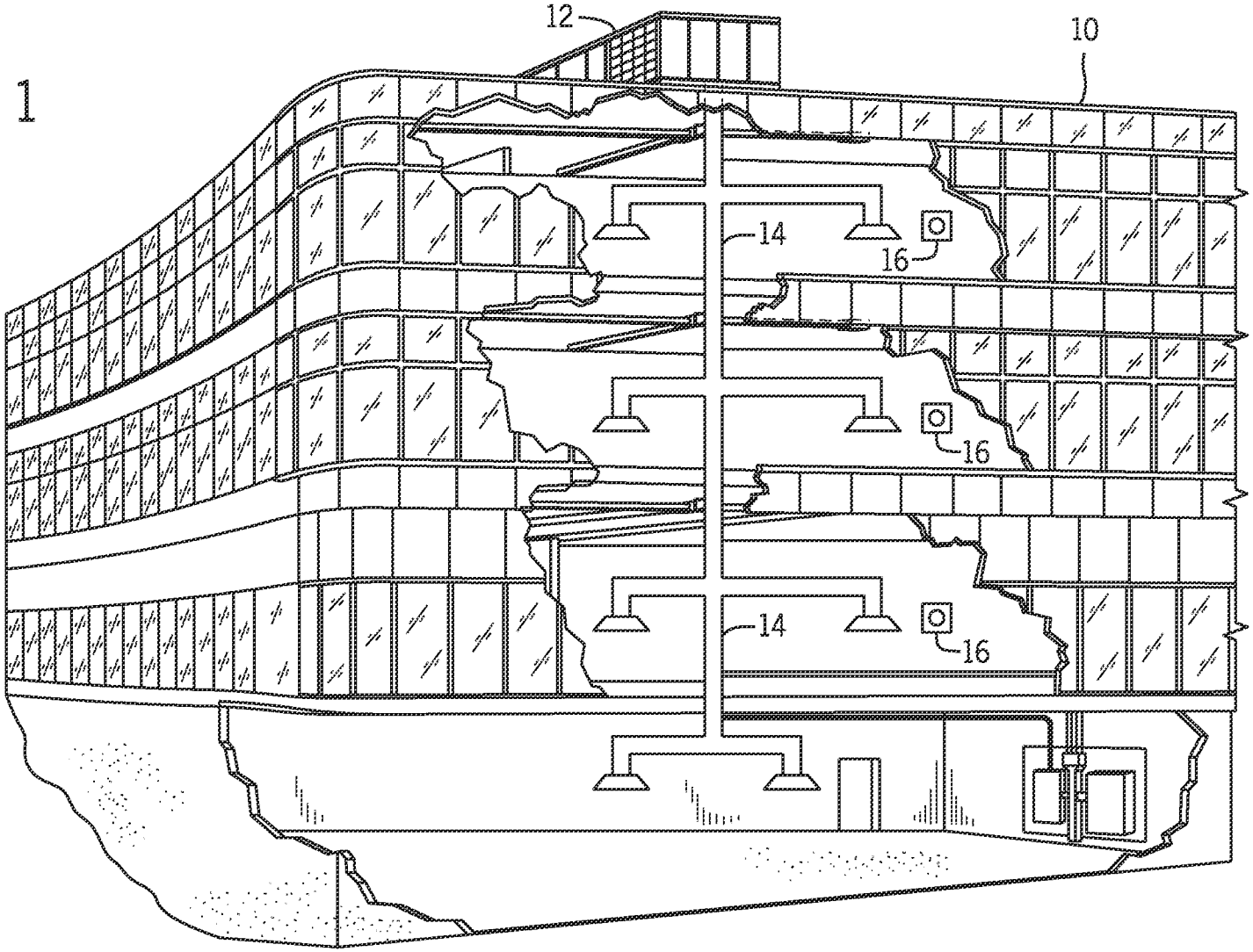
FIG. 1 is a perspective view of a building having an embodiment of a heating, ventilation, and air conditioning (HVAC) system for environmental management that may employ one or more HVAC units in accordance with an aspect of the present disclosure.

One or more specific embodiments will be described below. In an effort to provide a concise description of these embodiments, not all features of an actual implementation are described in the specification. It should be noted that in the development of any such actual implementation, as in any engineering or design project, numerous implementation-specific decisions must be made to achieve the developers' specific goals, such as compliance with system-related and business-related constraints, which may vary from one implementation to another. Moreover, it should be noted that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be noted that references to "one embodiment" or "an embodiment" of the present disclosure are not intended to be interpreted as excluding the existence of additional embodiments that also incorporate the recited features.

The present disclosure is directed to a heating, ventilation, and air conditioning (HVAC) system. The HVAC system may include a rooftop unit or a packaged HVAC unit that includes one or more partition walls that separate components of the HVAC unit and/or support the various components within the HVAC unit. Further, the partition walls may define one or more compartments within the HVAC unit and/or divide the HVAC unit into two or more internal volumes. In traditional systems, the partition walls may include a double layered structure and each layer may include a plurality of panels coupled together by C-channels disposed between adjacent panels. The adjacent panels may be coupled to the C-channels by mechanical securements (e.g., screws, fasteners, pins, rods, gaskets, and the like). Unfortunately, traditional systems may employ a large number of mechanical securements (e.g., screws, fasteners, gaskets) to facilitate the coupling of adjoining panels to one another, and or coupling of the panels to one or more components of the housing of the HVAC unit.

It is now recognized that HVAC systems employing improved partition walls, in accordance with the present disclosure, can limit the number of components within the HVAC unit. By reducing the number of components within the HVAC system, costs associated with the construction of the HVAC system may be limited or reduced. Further, an amount of time to assemble the HVAC system may be reduced which may further limit costs and improve an efficiency of employing the HVAC system. For example, the partition walls disclosed herein may include one or more panels that are slidably coupled to a frame of a housing of the HVAC system. The one or more panels may be coupled to one another to provide an airtight connection (e.g., airtight engagement, contact) between adjoining panels without the use of mechanical securements (e.g., fasteners, screws, gaskets, and the like). This may be referred to as toolless engagement or toolless airtight engagement between the panels because panel components facilitate the engagement without the need to use fasteners and the like to create the referenced engagement (e.g., airtight overlap). In this way, the one or more partitions may separate the HVAC unit into various compartments while limiting an amount of mechanical securements utilized to support and/or couple the partition walls. Thus, use of the presently disclosed partition walls may reduce time and costs associated with the construction and assembly of the HVAC unit.

Turning now to the drawings, which each represent a system or system component that incorporates or includes a partition wall in accordance with the present disclosure, FIG. 1 illustrates a heating, ventilation, and air conditioning (HVAC) system for building environmental management that may employ one or more HVAC units. As used herein, an HVAC system includes any number of components configured to enable regulation of parameters related to climate characteristics, such as temperature, humidity, air flow, pressure, air quality, and so forth. For example, an "HVAC system" as used herein is defined as conventionally understood and as further described herein. Components or parts of an "HVAC system" may include, but are not limited to, all, some of, or individual parts such as a heat exchanger, a heater, an air flow control device, such as a fan, a sensor configured to detect a climate characteristic or operating parameter, a filter, a control device configured to regulate operation of an HVAC system component, a component configured to enable regulation of climate characteristics, or a combination thereof. An "HVAC system" is a system configured to provide such functions as heating, cooling, ventilation, dehumidification, pressurization, refrigeration, filtration, or any combination thereof. The embodiments described herein may be utilized in a variety of applications to control climate characteristics, such as residential, commercial, industrial, transportation, or other applications where climate control is desired.

In the illustrated embodiment, a building 10 is air conditioned by a system that includes an HVAC unit 12. The building 10 may be a commercial structure or a residential structure. As shown, the HVAC unit 12 is disposed on the roof of the building 10; however, the HVAC unit 12 may be located in other equipment rooms or areas adjacent the building 10. The HVAC unit 12 may be a single package unit containing other equipment, such as a blower, integrated air handler, and/or auxiliary heating unit. In other embodiments, the HVAC unit 12 may be part of a split HVAC system, such as the system shown in FIG. 3, which includes an outdoor HVAC unit 58 and an indoor HVAC unit 56.

The HVAC unit 12 is an air cooled device that implements a refrigeration cycle to provide conditioned air to the building 10. Specifically, the HVAC unit 12 may include one or more heat exchangers across which an air flow is passed to condition the air flow before the air flow is supplied to the building. In the illustrated embodiment, the HVAC unit 12 is a rooftop unit (RTU) that conditions a supply air stream, such as environmental air and/or a return air flow from the building 10. After the HVAC unit 12 conditions the air, the air is supplied to the building 10 via ductwork 14 extending throughout the building 10 from the HVAC unit 12. In certain embodiments, the HVAC unit 12 may be a heat pump that provides both heating and cooling to the building with one refrigeration circuit configured to operate in different modes. In other embodiments, the HVAC unit 12 may include one or more refrigeration circuits for cooling an air stream and a furnace for heating the air stream. Aspects of the HVAC unit 12 may be supported or partitioned with a partition wall in accordance with the present disclosure.

A control device 16, one type of which may be a thermostat, may be used to designate the temperature of the conditioned air. The control device 16 also may be used to control the flow of air through the ductwork 14. For example, the control device 16 may be used to regulate operation of one or more components of the HVAC unit 12 or other components, such as dampers and fans, within the building 10 that may control flow of air through and/or from the ductwork 14. In some embodiments, other devices may be included in the system, such as pressure and/or temperature transducers or switches that sense the temperatures and pressures of the supply air, return air, and so forth. Moreover, the control device 16 may include computer systems that are integrated with or separate from other building control or monitoring systems, and even systems that are remote from the building 10.

Figure 2:
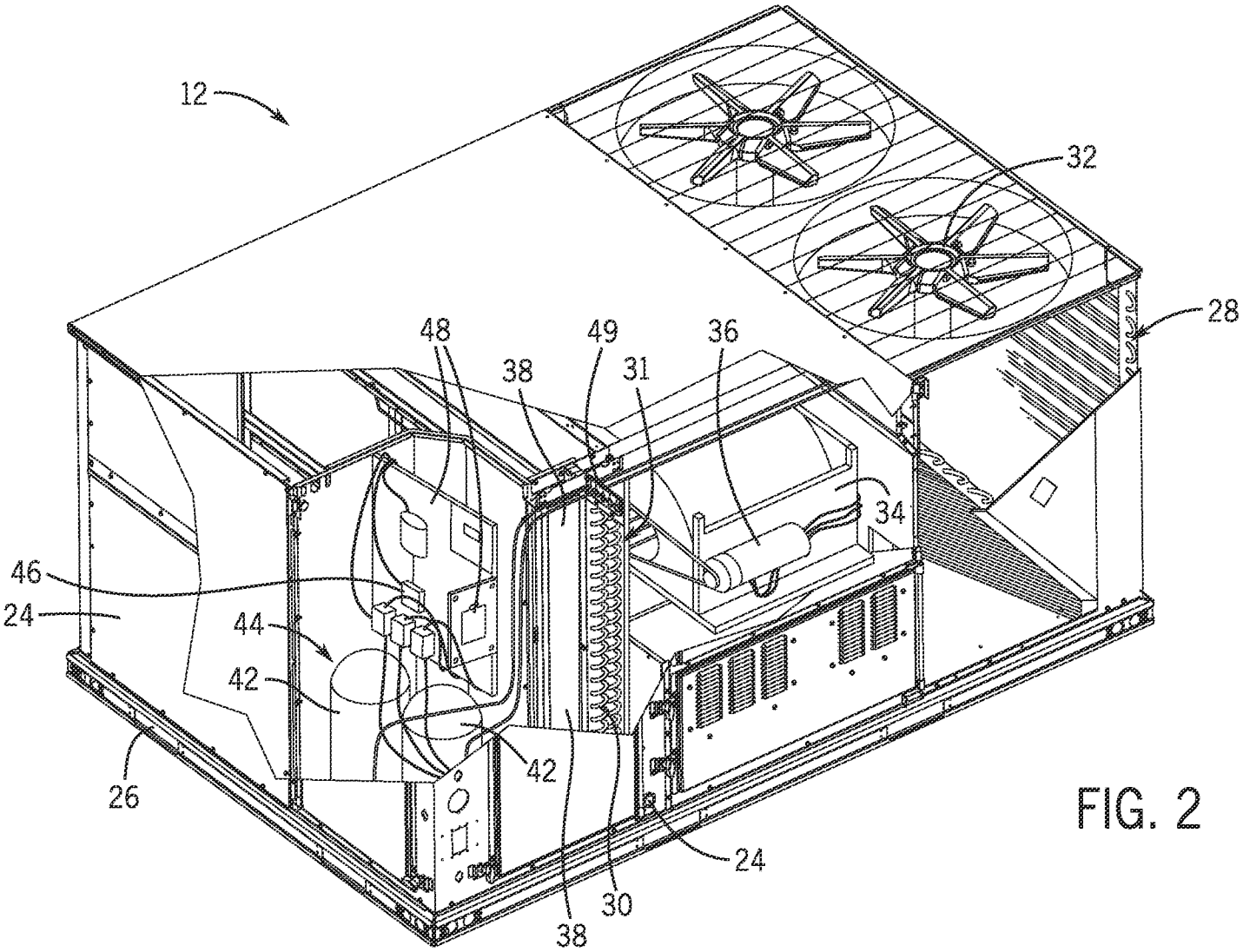
FIG. 2 is a perspective view of an embodiment of a packaged HVAC unit that may be used in the HVAC system of FIG. 1, in accordance with an aspect of the present disclosure.

FIG. 2 is a perspective view of an embodiment of the HVAC unit 12. In the illustrated embodiment, the HVAC unit 12 is a single package unit that may include one or more independent refrigeration circuits and components that are tested, charged, wired, piped, and ready for installation. The HVAC unit 12 may provide a variety of heating and/or cooling functions, such as cooling only, heating only, cooling with electric heat, cooling with dehumidification, cooling with gas heat, or cooling with a heat pump. As described above, the HVAC unit 12 may directly cool and/or heat an air stream provided to the building 10 to condition a space in the building 10.

As shown in the illustrated embodiment of FIG. 2, a cabinet 24 (which may be formed from partition walls in accordance with present embodiments) encloses the HVAC unit 12 and provides structural support and protection to the internal components from environmental and other contaminants. In some embodiments, the cabinet 24 may be constructed of galvanized steel and insulated with aluminum foil faced insulation. Rails 26 may be joined to the bottom perimeter of the cabinet 24 and provide a foundation for the HVAC unit 12. In certain embodiments, the rails 26 may provide access for a forklift and/or overhead rigging to facilitate installation and/or removal of the HVAC unit 12. In some embodiments, the rails 26 may fit onto "curbs" on the roof to enable the HVAC unit 12 to provide air to the ductwork 14 from the bottom of the HVAC unit 12 while blocking elements such as rain from leaking into the building 10.

The HVAC unit 12 includes heat exchangers 28 and 30 in fluid communication with one or more refrigeration circuits. Tubes within the heat exchangers 28 and 30 may circulate refrigerant, such as R-410A, through the heat exchangers 28 and 30. The tubes may be of various types, such as multichannel tubes, conventional copper or aluminum tubing, and so forth. Together, the heat exchangers 28 and 30 may implement a thermal cycle in which the refrigerant undergoes phase changes and/or temperature changes as it flows through the heat exchangers 28 and 30 to produce heated and/or cooled air. For example, the heat exchanger 28 may function as a condenser where heat is released from the refrigerant to ambient air, and the heat exchanger 30 may function as an evaporator where the refrigerant absorbs heat to cool an air stream. In other embodiments, the HVAC unit 12 may operate in a heat pump mode where the roles of the heat exchangers 28 and 30 may be reversed. That is, the heat exchanger 28 may function as an evaporator and the heat exchanger 30 may function as a condenser. In further embodiments, the HVAC unit 12 may include a furnace for heating the air stream that is supplied to the building 10. While the illustrated embodiment of FIG. 2 shows the HVAC unit 12 having two of the heat exchangers 28 and 30, in other embodiments, the HVAC unit 12 may include one heat exchanger or more than two heat exchangers.

The heat exchanger 30 is located within a compartment 31 that separates the heat exchanger 30 from the heat exchanger 28. Fans 32 draw air from the environment through the heat exchanger 28. Air may be heated and/or cooled as the air flows through the heat exchanger 28 before being released back to the environment surrounding the HVAC unit 12. A blower assembly 34, powered by a motor 36, draws air through the heat exchanger 30 to heat or cool the air. The heated or cooled air may be directed to the building 10 by the ductwork 14, which may be connected to the HVAC unit 12. Before flowing through the heat exchanger 30, the conditioned air flows through one or more filters 38 that may remove particulates and contaminants from the air. In certain embodiments, the filters 38 may be disposed on the air intake side of the heat exchanger 30 to prevent contaminants from contacting the heat exchanger 30.

The HVAC unit 12 also may include other equipment for implementing the thermal cycle. Compressors 42 increase the pressure and temperature of the refrigerant before the refrigerant enters the heat exchanger 28. The compressors 42 may be any suitable type of compressors, such as scroll compressors, rotary compressors, screw compressors, or reciprocating compressors. In some embodiments, the compressors 42 may include a pair of hermetic direct drive compressors arranged in a dual stage configuration 44. However, in other embodiments, any number of the compressors 42 may be provided to achieve various stages of heating and/or cooling. Additional equipment and devices may be included in the HVAC unit 12, such as a solid-core filter drier, a drain pan, a disconnect switch, an economizer, pressure switches, phase monitors, and humidity sensors, among other things.

The HVAC unit 12 may receive power through a terminal block 46. For example, a high voltage power source may be connected to the terminal block 46 to power the equipment. The operation of the HVAC unit 12 may be governed or regulated by a control board 48. The control board 48 may include control circuitry connected to a thermostat, sensors, and alarms. One or more of these components may be referred to herein separately or collectively as the control device 16. The control circuitry may be configured to control operation of the equipment, provide alarms, and monitor safety switches. Wiring 49 may connect the control board 48 and the terminal block 46 to the equipment of the HVAC unit 12.

Figure 3:
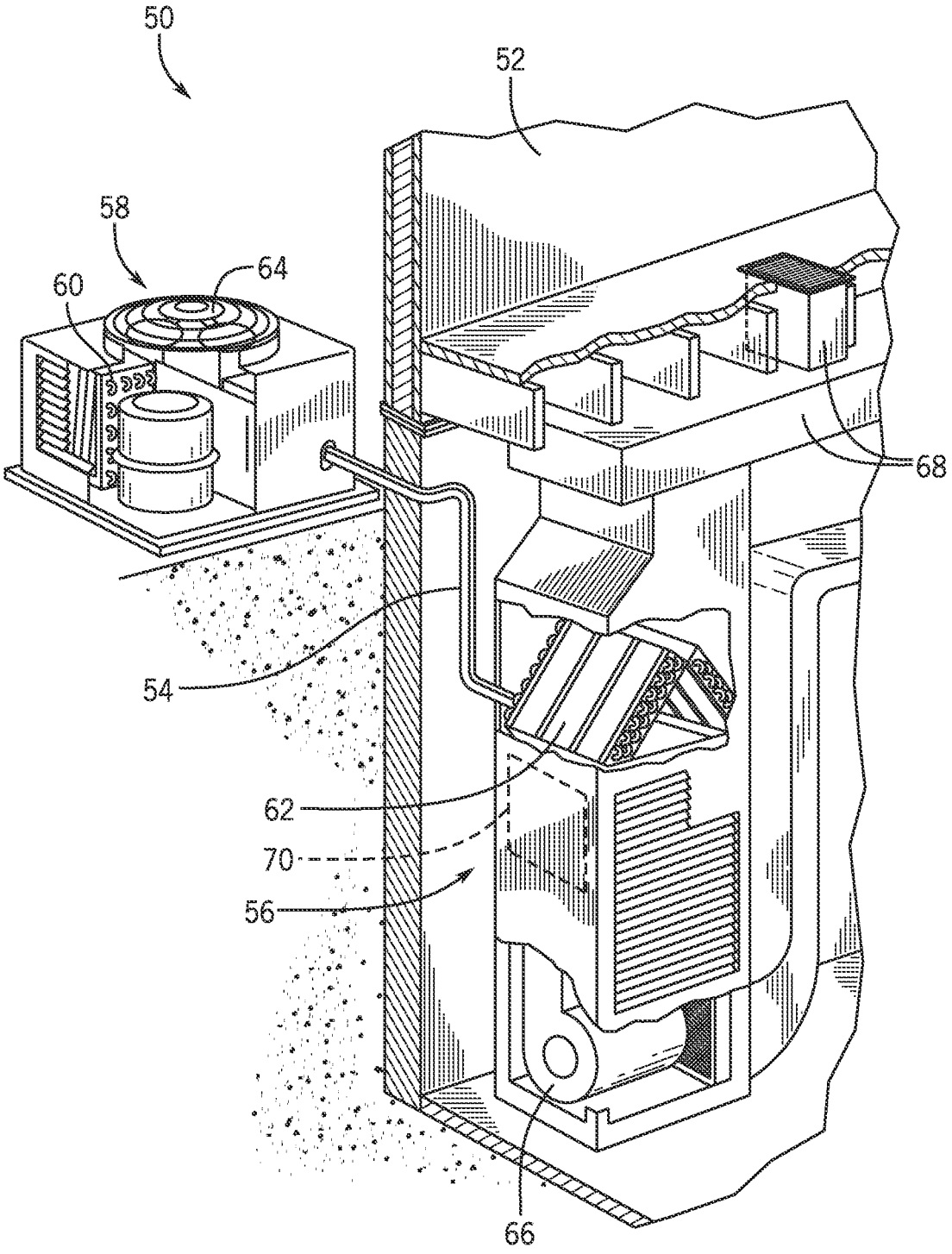
FIG. 3 is a cutaway perspective view of an embodiment of a residential, split HVAC system, in accordance with an aspect of the present disclosure.

FIG. 3 illustrates a residential heating and cooling system 50, also in accordance with present techniques. The residential heating and cooling system 50 may provide heated and cooled air to a residential structure, as well as provide outside air for ventilation and provide improved indoor air quality (IAQ) through devices such as ultraviolet lights and air filters. In the illustrated embodiment, the residential heating and cooling system 50 is a split HVAC system. In general, a residence 52 conditioned by a split HVAC system may include refrigerant conduits 54 that operatively couple the indoor unit 56 to the outdoor unit 58. The indoor unit 56 may be positioned in a utility room, an attic, a basement, and so forth. The outdoor unit 58 is typically situated adjacent to a side of residence 52 and is covered by a shroud to protect the system components and to prevent leaves and other debris or contaminants from entering the unit. The refrigerant conduits 54 transfer refrigerant between the indoor unit 56 and the outdoor unit 58, typically transferring primarily liquid refrigerant in one direction and primarily vaporized refrigerant in an opposite direction.

When the system shown in FIG. 3 is operating as an air conditioner, a heat exchanger 60 in the outdoor unit 58 serves as a condenser for re-condensing vaporized refrigerant flowing from the indoor unit 56 to the outdoor unit 58 via one of the refrigerant conduits 54. In these applications, a heat exchanger 62 of the indoor unit functions as an evaporator. Specifically, the heat exchanger 62 receives liquid refrigerant, which may be expanded by an expansion device, and evaporates the refrigerant before returning it to the outdoor unit 58.

The outdoor unit 58 draws environmental air through the heat exchanger 60 using a fan 64 and expels the air above the outdoor unit 58. When operating as an air conditioner, the air is heated by the heat exchanger 60 within the outdoor unit 58 and exits the unit at a temperature higher than it entered. The indoor unit 56 includes a blower or fan 66 that directs air through or across the indoor heat exchanger 62, where the air is cooled when the system is operating in air conditioning mode. Thereafter, the air is passed through ductwork 68 that directs the air to the residence 52. The overall system operates to maintain a desired temperature as set by a system controller. When the temperature sensed inside the residence 52 is higher than the set point on the thermostat, or the set point plus a small amount, the residential heating and cooling system 50 may become operative to refrigerate additional air for circulation through the residence 52. When the temperature reaches the set point, or the set point minus a small amount, the residential heating and cooling system 50 may stop the refrigeration cycle temporarily.

The residential heating and cooling system 50 may also operate as a heat pump. When operating as a heat pump, the roles of heat exchangers 60 and 62 are reversed. That is, the heat exchanger 60 of the outdoor unit 58 will serve as an evaporator to evaporate refrigerant and thereby cool air entering the outdoor unit 58 as the air passes over the outdoor heat exchanger 60. The indoor heat exchanger 62 will receive a stream of air blown over it and will heat the air by condensing the refrigerant.

In some embodiments, the indoor unit 56 may include a furnace system 70. For example, the indoor unit 56 may include the furnace system 70 when the residential heating and cooling system 50 is not configured to operate as a heat pump. The furnace system 70 may include a burner assembly and heat exchanger, among other components, inside the indoor unit 56. Fuel is provided to the burner assembly of the furnace system 70 where it is mixed with air and combusted to form combustion products. The combustion products may pass through tubes or piping in a heat exchanger, separate from heat exchanger 62, such that air directed by the blower or fan 66 passes over the tubes or pipes and extracts heat from the combustion products. The heated air may then be routed from the furnace system 70 to the ductwork 68 for heating the residence 52.

Figure 4:
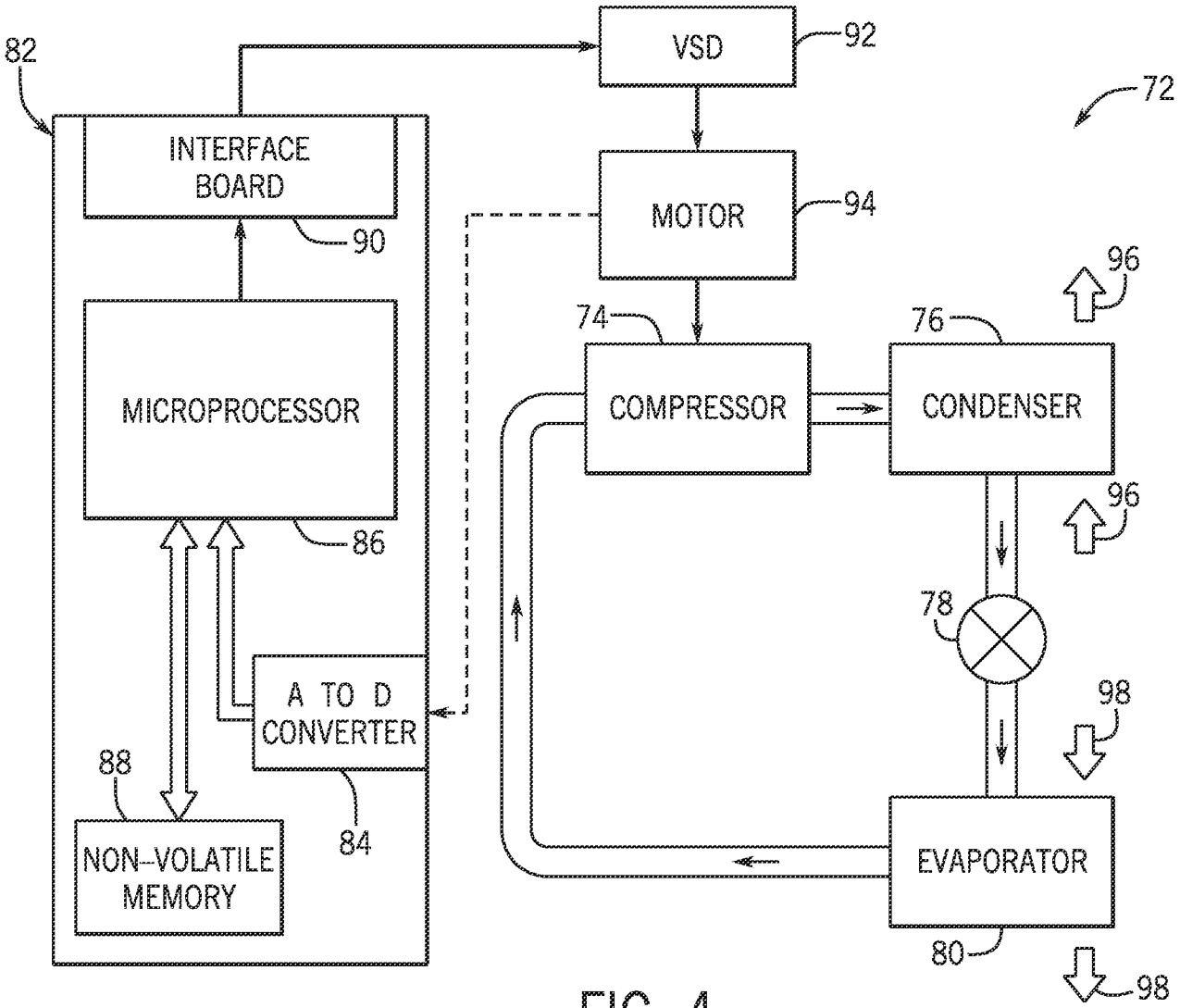
FIG. 4 is a schematic illustration of an embodiment of a vapor compression system that can be used in any of the systems of FIGS. 1-3, in accordance with an aspect of the present disclosure.

FIG. 4 is an embodiment of a vapor compression system 72 that can be used in any of the systems described above. The vapor compression system 72 may circulate a refrigerant through a circuit starting with a compressor 74. The circuit may also include a condenser 76, an expansion valve(s) or device(s) 78, and an evaporator 80. The vapor compression system 72 may further include a control panel 82 that has an analog to digital (A/D) converter 84, a microprocessor 86, a non-volatile memory 88, and/or an interface board 90. The control panel 82 and its components may function to regulate operation of the vapor compression system 72 based on feedback from an operator, from sensors of the vapor compression system 72 that detect operating conditions, and so forth.

In some embodiments, the vapor compression system 72 may use one or more of a variable speed drive (VSDs) 92, a motor 94, the compressor 74, the condenser 76, the expansion valve or device 78, and/or the evaporator 80. The motor 94 may drive the compressor 74 and may be powered by the variable speed drive (VSD) 92. The VSD 92 receives alternating current (AC) power having a particular fixed line voltage and fixed line frequency from an AC power source, and provides power having a variable voltage and frequency to the motor 94. In other embodiments, the motor 94 may be powered directly from an AC or direct current (DC) power source. The motor 94 may include any type of electric motor that can be powered by a VSD or directly from an AC or DC power source, such as a switched reluctance motor, an induction motor, an electronically commutated permanent magnet motor, or another suitable motor.

The compressor 74 compresses a refrigerant vapor and delivers the vapor to the condenser 76 through a discharge passage. In some embodiments, the compressor 74 may be a centrifugal compressor. The refrigerant vapor delivered by the compressor 74 to the condenser 76 may transfer heat to a fluid passing across the condenser 76, such as ambient or environmental air 96. The refrigerant vapor may condense to a refrigerant liquid in the condenser 76 as a result of thermal heat transfer with the environmental air 96. The liquid refrigerant from the condenser 76 may flow through the expansion device 78 to the evaporator 80.

The liquid refrigerant delivered to the evaporator 80 may absorb heat from another air stream, such as a supply air stream 98 provided to the building 10 or the residence 52. For example, the supply air stream 98 may include ambient or environmental air, return air from a building, or a combination of the two. The liquid refrigerant in the evaporator 80 may undergo a phase change from the liquid refrigerant to a refrigerant vapor. In this manner, the evaporator 80 may reduce the temperature of the supply air stream 98 via thermal heat transfer with the refrigerant. Thereafter, the vapor refrigerant exits the evaporator 80 and returns to the compressor 74 by a suction line to complete the cycle.

In some embodiments, the vapor compression system 72 may further include a reheat coil in addition to the evaporator 80. For example, the reheat coil may be positioned downstream of the evaporator relative to the supply air stream 98 and may reheat the supply air stream 98 when the supply air stream 98 is overcooled to remove humidity from the supply air stream 98 before the supply air stream 98 is directed to the building 10 or the residence 52.

It should be appreciated that any of the features described herein may be incorporated with the HVAC unit 12, the residential heating and cooling system 50, or other HVAC systems. Additionally, while the features disclosed herein are described in the context of embodiments that directly heat and cool a supply air stream provided to a building or other load, embodiments of the present disclosure may be applicable to other HVAC systems as well. For example, the features described herein may be applied to mechanical cooling systems, free cooling systems, chiller systems, or other heat pump or refrigeration applications.

Further, any of the systems illustrated in FIGS. 1-4 may include or operate in conjunction with a housing (e.g., cabinet) that includes one or more partition walls in accordance with the present disclosure, such as the cabinet 24 of FIG. 2. For example, the cabinet 24 of FIG. 2 may enclose the HVAC unit 12 and provide structural support and protection to various internal components from environmental and other contaminants. The cabinet 24 may also include one or more partition walls in accordance with present embodiments to define compartments within the cabinet 24 and separate various components from one another to improve efficiency of the HVAC unit 12.

In accordance with the present disclosure, a heating, ventilation, and air conditioning (HVAC) device may include a housing (e.g., cabinet, enclosure) configured to provide structural support and protection to various internal components. The housing may be defined by one or more partition walls and one or more partition walls may extend within the housing to define various compartments within the housing that may enclose one or more of the various internal components. The one or more partition walls may also provide structural support for the HVAC device and may enable one or more airflows to be directed through the HVAC device. The one or more partition walls may extend between and be enclosed by a first support member, a second support member, a first cross-rail, and a second cross-rail. That is, the top cross rail, the bottom cross rail, the first support member and the second support member form a frame or structure that defines an outer periphery of a partition wall. Further, the partition wall may include one or more panels disposed between the first support member and the second support member, and the one or more panels may overlap to create an airtight contact without the requirement of fasteners and/or screws. As used herein, an "airtight" contact (e.g., connection, seal) may refer to a connection between adjoining panels and/or a connection between a panel and a support member and/or cross-rail that substantially limits an airflow from passing therethrough or therebetween. By limiting the use of fasteners, partition walls may be formed with a reduced number of mechanical components which may reduce costs, and HVAC systems employing the configuration discussed herein may be less susceptible to degradation, operating interruptions, and/or inefficiencies that may otherwise occur in traditional HVAC systems.

Figure 5:
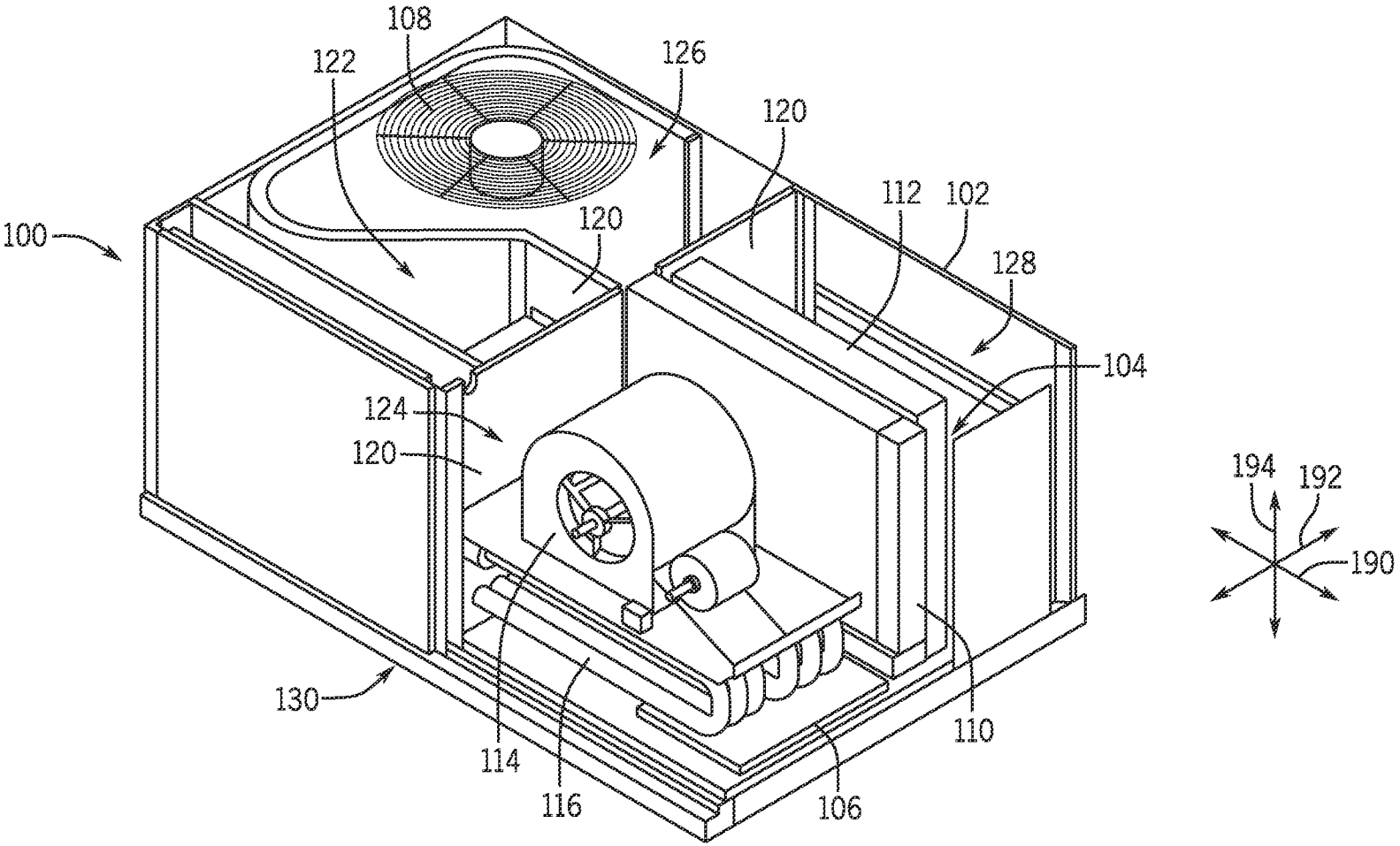
FIG. 5 is a perspective view of an embodiment of a packaged HVAC unit, in accordance with an aspect of the present disclosure.

With this in mind, FIG. 5 is a perspective view of an embodiment of a packaged HVAC unit 100 that may employ one or more of the partition walls disclosed herein. In the illustrated embodiment, the packaged HVAC unit 100 includes multiple components enclosed within an internal volume of a housing 102 of the packaged HVAC unit 100. The packaged HVAC unit 100 may be configured to circulate air and therefore may include a return section 104 to receive an air flow, such as a return air flow from the building 10, and a supply section 106 to output an air flow, such as a supply air flow. As an example, the packaged HVAC unit 100 may be located in an outside environment, such as on a rooftop, and may be coupled to ductwork that directs air to and/or from rooms or other areas within a building, such as the building 10 of FIG. 1. The ductwork may couple to the return section 104 and the supply section 106. In this manner, the packaged HVAC unit 100 may circulate air in the building 10.

In addition to circulating air, the packaged HVAC unit 100 may change the temperature of the supply air flow directed therethrough. For example, the packaged HVAC unit 100 may include a refrigerant circuit that circulates a refrigerant therethrough, where the refrigerant circuit is in thermal communication with the air flow. The refrigerant may flow through a condenser 108, where the refrigerant may be cooled. FIG. 5 illustrates the condenser 108 as including a fan that may direct ambient air across the condenser 108 to remove heat from the refrigerant via convection, but in other embodiments, the condenser 108 may use another means of cooling the refrigerant, such as via a coolant. After being cooled, the refrigerant may then flow through an evaporator 110, where the refrigerant may absorb heat from the air flow (e.g., supply air flow) directed across the evaporator 110. Thus, the refrigerant may be heated, and the air flow may be cooled at the evaporator 110. After being heated at the evaporator 110, the refrigerant may return to the condenser 108 where it may once again be cooled. It should be appreciated that the refrigerant circuit may include other components, such as a compressor, expansion valve, and so forth that enable conditioning of the supply air flow via the refrigerant.

The packaged HVAC unit 100 may also be configured to operate in a heating mode and a cooling mode. During operation of the heating mode, air may be received by the packaged HVAC unit 100 at the return section 104 to enter an air flow path. As mentioned, air (e.g., return air) may be received from ductwork that is connected to a building. However, in other embodiments, air received by the packaged HVAC unit 100 may be ambient air, such as from an outside environment. In certain embodiments, the supply air flow directed through the packaged HVAC unit 100 may include air from the return section 104 as well as ambient air. After the air flow enters the packaged HVAC unit 100, the air flow may pass across a filter 112. The filter 112 may remove particles from the air flow, such as dirt or other debris. The filter 112 may be a pleated filer, an electrostatic filter, a HEPA filter, or a fiber glass filter that traps the debris when the air flow passes through the filter 112. After being filtered, the air flow may be directed to the evaporator 110. As discussed above, at the evaporator 110, the air flow may be cooled by transferring heat to the refrigerant within the evaporator 110. In addition, cooling the air flow may also remove moisture from the air flow and thus, the packaged HVAC unit 100 may also dehumidify the air flow. Once cooled, the air flow may be directed through a blower 114, which may increase the velocity of the air flow and discharge the air flow as supply air via the supply section 106 of the packaged HVAC unit 100. Thereafter, the supply air flow may be circulated through the ductwork. In some embodiments, the blower 114 may also operate to draw air through the return section 104 and thereby function to both draw in and expel air.

In some modes of operation (e.g., a heating mode), prior to exiting the packaged HVAC unit 100, the air may be heated by a heat exchanger 116 (e.g., a furnace). By way of example, the heat exchanger 116 may be coupled to a heat source. In some embodiments, the heat exchanger 116 may be a gas heat exchanger and may be coupled to a gas burner (e.g., a burner assembly) that combusts a fuel (e.g., air-fuel mixture), such as acetylene, natural gas, propane, another gas, or any combination thereof to produce combustion products having an elevated temperature that are directed into the heat exchanger 116. When the air flow is directed across the heat exchanger 116, the air flow may absorb heat from the combustion products, thereby increasing the temperature of the air flow. Thereafter, the air flow may then exit the packaged HVAC unit 100 at a higher temperature compared to the air flow entering the packaged HVAC unit 100. During a cooling mode of the packaged HVAC unit 100, the heat exchanger 116 may be inoperative (e.g., turned off).

To separate various components within the packaged HVAC unit 100, the packaged HVAC unit 100 may include one or more partition walls 120 (e.g., walls, panels, vestibule panels, dividers, separation plates, etc.) extending from a base 130 of the housing 102. As an example, the partition wall 120 may divide the internal volume defined by the housing 102 into a first volume 122, which may contain the heat source (e.g., burner assembly) of the heat exchanger 116, a second volume 124 (e.g., supply air section) from which the supply air flow may exit the packaged HVAC unit 100, a third volume 126 that contains the condenser 108, and a fourth volume 128 (e.g., return air section 104) configured to receive an air flow directed into the packaged HVAC unit 100. Various components of the packaged HVAC unit 100 may also be oriented along a number of axes including a lateral axis 190 (e.g., a horizontal axis), a longitudinal axis 192 (e.g., a horizontal axis), and a vertical axis 194.

Figure 6:
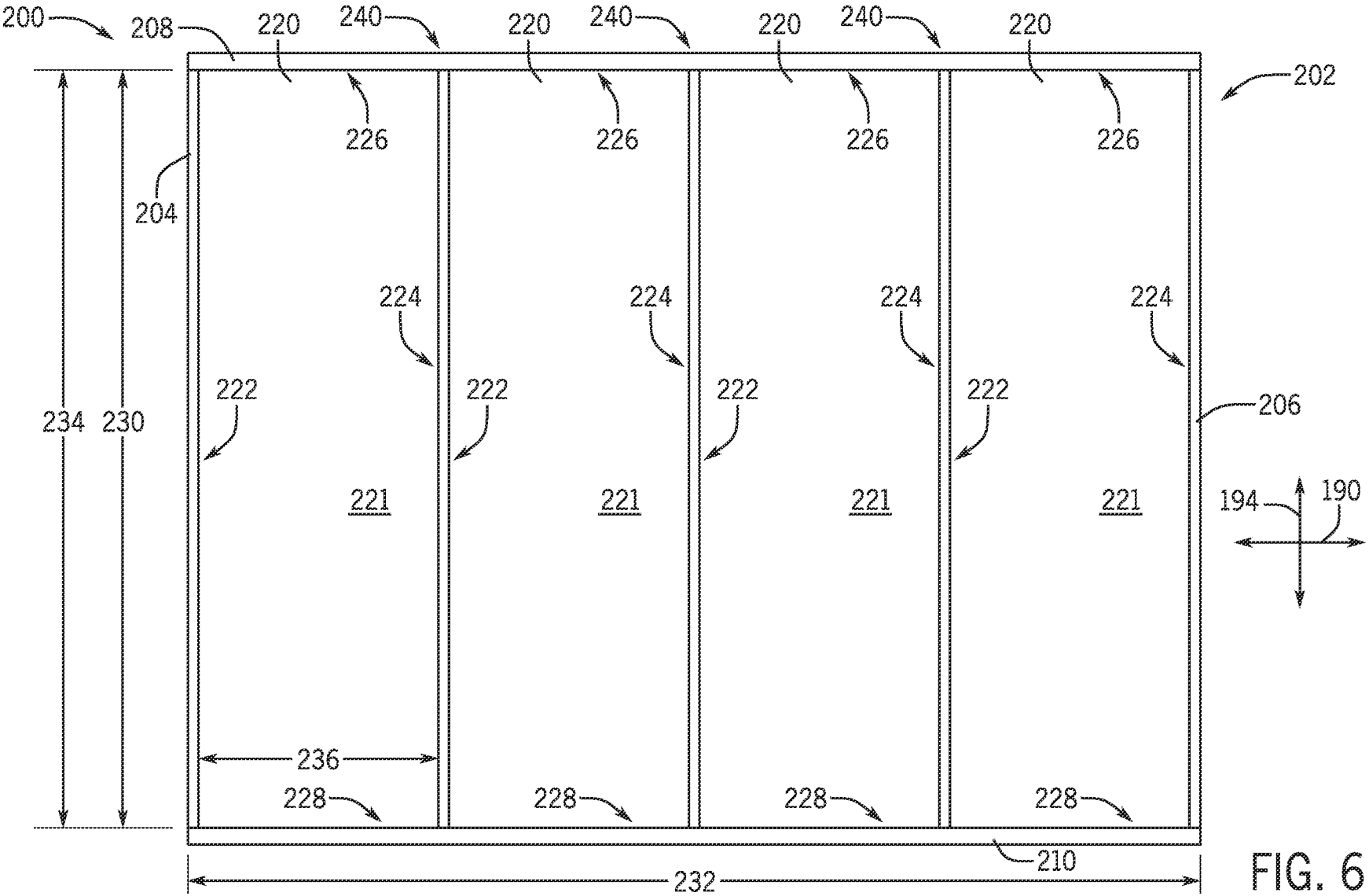
FIG. 6 is a front view of an embodiment of a partition wall that can be used in any of the systems of FIGS. 1-5, in accordance with an aspect of the present disclosure.

FIG. 6 is a front view of a partition wall 200 (e.g., wall, panel, vestibule, divider, separation plate) for an HVAC device that can be used with or in any of the systems of FIGS. 1-5 or any other suitable HVAC system. For example, the partition wall 200 may correspond to the partition walls 120 of the packaged HVAC unit 100 of FIG. 5. Boundaries of the partition wall 200 may be defined by a frame 202 (e.g., support structure) which may be a section (e.g., a base) of a housing of an HVAC unit, such as the base 130 of the housing 102 of FIG. 5. In some embodiments, the frame 202 may define a perimeter of an HVAC unit, such that a partition wall 200 enclosed by the frame 200 may define an outer wall of the HVAC unit. In other embodiments, the frame 202 may be disposed within an interior of an HVAC unit, such that a partition wall 200 enclosed by the frame 200 may enable a housing, such as the housing 102 of FIG. 5 to be separated into one or more internal volumes. While the partition wall 200 is represented as a substantially flat and rectangular wall, in other embodiments, it may include curves, contours, a different shape, and so forth.

The frame 202 may include a first support member 204, a second support member 206, a first cross rail 208 (e.g., top cross rail), and a second cross rail 210 (e.g., bottom cross rail) extending between the first and second support members 204, 206. The first support member 204 and the second support member 206 of the frame 202 may extend for a distance 230 (e.g., height) in a direction (vertical direction) along the vertical axis 194 and may be configured to strengthen and support the housing of the HVAC device. The first cross rail 208 and the second cross rail 210 may extend between the first support member 204 and the second support member for a distance 232 (e.g., length) in a direction (e.g., horizontal direction) along the horizontal axis 190. Thus, the first and second cross rails 208, 210 may be substantially orthogonal to the first and second support members 204, 206, and the frame 202 may be a quadrilateral frame or structure that defines outer periphery of the partition wall 200.

The partition wall 200 includes one or more panels 220 disposed between the first support member 204 and the second support member 206, and each of the one or more of the panels 220 may at least be partially defined by the first cross rail 208 and the second cross rail 210. Further, one or more of the panels 220 may also be partially defined by the first support member 204 and the second support member 206. In some embodiments, the one or more panels 220 may be slidably coupled to the first cross rail 208 and the second cross rail 210, thereby enabling the one or more panels 220 to slide along the length 232 of the frame 202 in a direction along the horizontal axis 190. In other embodiments, the one or more panels 220 may be snap-fitted to either or both the first cross rail 208 and the second cross rail 210. In still other embodiments, the one or more panels 220 may have a shape selected from, but not limited to, a rectangle, square, or quadrangular, such that the one or more panels 220 are at least partially enclosed by the frame 202. As illustrated, each of the panels 220 may extend for a distance 234 (e.g., height) in a direction along the vertical axis 194, and for a distance 236 (e.g., length) in a direction along the horizontal axis 190. The distance 234 may be equal to the distance 230 such that the panels extend within the frame 202 from the first cross rail 208 to the second cross rail 210, and the distance 236 may be less than the distance 232 such that two or more panels extend within the frame 202. In other embodiments, a single panel 220 may be used to form the partition wall 200, as described in greater detail below. Further, the one or more panels 220 may be composed of one of, but not limited to, a polymer-based material, stainless steel, or galvanized steel. It should be noted that although the partition wall 200 of FIG. 6 includes four panels 220 within the frame 202, it is to be understood that the partition wall 200 may include one, two, three, four, five, six, or more panels 220.

Each panel 220 may include a first side 222, a second side 224, a third side 226, and a fourth side 228 that define a first surface 221 of the panel 220 and a second surface 223 (not shown) of the panel 220. The third side 226 and/or the fourth side 228 of each panel 220 may be configured to couple (e.g., slidably couple) the panel 220 to the first cross rail 208 and/or the second cross rail 210 respectively, thereby enabling each panel 220 to slide along the length 232 of the frame 202 in a direction (e.g., horizontal direction) along the horizontal axis 190. Typically, a channel 240 may be formed between adjacent panels 220. For example, the channel 240 may be defined by the second side 224 of a panel 220 (e.g., a first panel), and the first side 222 of an adjoining panel 220 (e.g., a second panel) adjacent to the first panel 220. The channel 240 may extend in a direction along the vertical axis 194, and may be configured to provide reinforcement and enable an airtight coupling between adjacent panels 220 of the partition wall 200, as described in greater detail below.

Figure 7A:
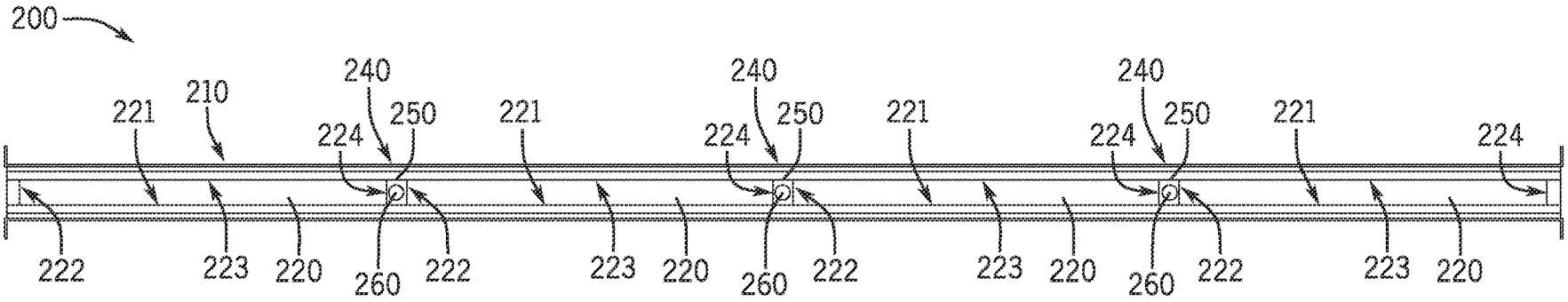
FIG. 7A is a cross-sectional, top-view of an embodiment of a partition wall, in accordance with an aspect of the present disclosure.

Now referring to FIGS. 7A-7F, a cross-sectional, top-view, and enhanced, cross-sectional, top-views of an embodiment of the partition wall 200 are shown, in accordance with an aspect of the present disclosure. As illustrated in FIG. 7A, the partition wall 200 may include the two or more panels 220, and each of the panels 220 may be at least partially defined by a first side 222, a second side 224, and a third side 226 that is slidably coupled to a first cross rail 208. Further, each of the panels 220 may include a first surface 221 (e.g., front surface) and a second surface 223 (e.g., rear surface). In some embodiments, the one or more panels 220 may be separated by a channel 240 which may be formed by the sides 222, 224 of adjoining panels and/or one or more components (e.g., flange, cavity, stiffeners) disposed along one or both of the sides 222, 224 of each panel 220.

Figure 7B:
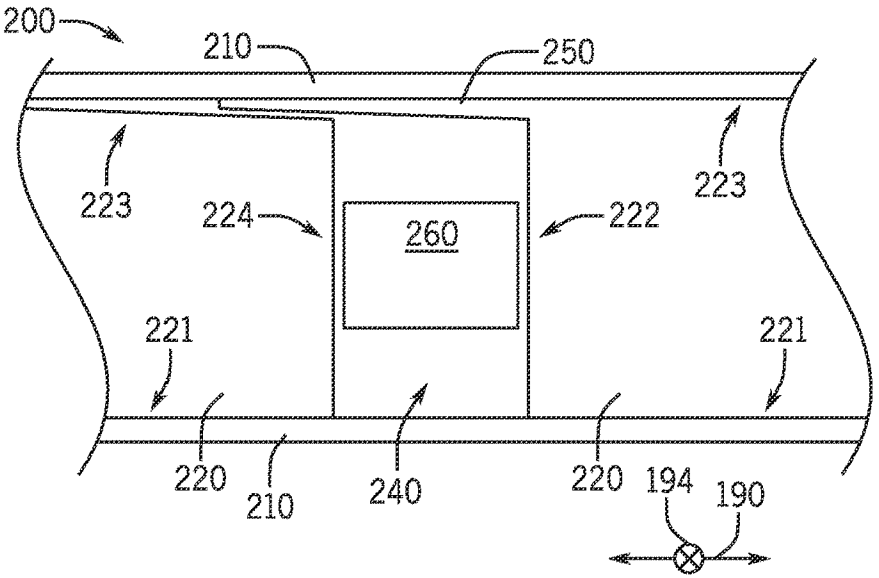
FIG. 7B is an enhanced, cross-sectional, top-view of an embodiment of the partition wall, in accordance with an aspect of the present disclosure.

For example, as illustrated in FIG. 7B, the panel 220 includes a flange 250 (e.g., extension, protrusion) that may extend in a direction along the horizontal axis 190 from the first side 222 of the panel 220 along the height 234 of the panel 220. In some embodiments, the flange 250 may extend from either the first side 222 or the second side 224 and each flange 250 may be substantially coplanar with the second surface 223 of the respective panel 220. For example, if the flange 250 extends from the first side 222 of the panel 220, then the second side 224 of the panel 220 opposite the first side 222, may have a substantially flat surface that is configured to receive a flange 250 from a first side 222 of an adjacent panel 220. That is, the flange 250 extending from a first side 222 of a second panel 220 may be configured to engage with (e.g., abut, overlap) a second side 224 of a first panel 220 to form an airtight contact (e.g., airtight engagement) there between without using fasteners or screws (e.g., mechanical securement). In some embodiments, the flange 250 may flex to engage with and/or overlap the second surface 223 of the adjoining panel 220.

As noted above, a channel 240 may be formed between adjacent panels 220, and may extend for the height of the panel (e.g., distance 234 of FIG. 6) in a direction along the vertical axis 194. Each channel 240 may be defined by a second side 224 of a panel 220, a first side 222 of an adjoining panel 220, and a flange 250 extending from the first side 220 of the adjoining panel 220. In some embodiments, a stiffener 260 may be provided within the channel 240 to provide reinforcement to the partition wall 200. In some embodiments, the channel 240 may circumscribe the stiffener 260 from three sides (e.g., a second side 224 of a panel 220, a first side 222 of an adjoining panel 220, and a flange 250 extending from the first side 220 of the adjoining panel). It should be noted that in some embodiments, a size of the channel 240 is related to engagement of the flange 250 with a receptacle, lip, or other feature of an adjacent panel (e.g., adjoining panel 220). For example, when the flange 250 slidingly engages with a feature of the adjoining panel 220, further sliding engagement may be essentially halted, which may leave the channel 240 as a gap between other features of the panels 220.

Figure 7C:
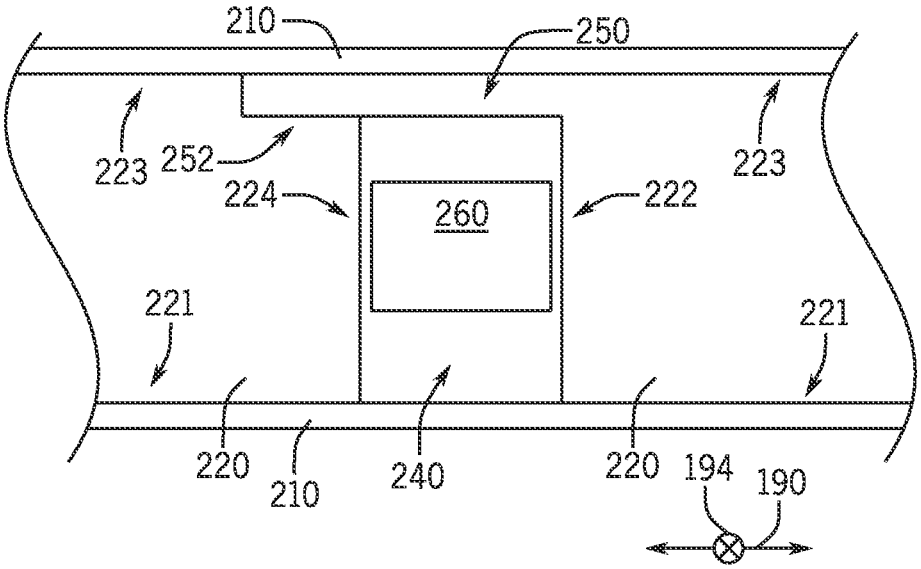
FIG. 7C is an enhanced, cross-sectional, top-view of an embodiment of the partition wall, in accordance with an aspect of the present disclosure.

Turning to FIG. 7C, in some embodiments, the second side 224 of the panels 220 may include a cavity 252 (e.g., receptacle, crevice) that extends along the height (e.g., distance 234 of FIG. 6) of the panel 220 in a direction along the vertical axis 194 and is configured to receive the flange 250 from the adjacent panel 220 to facilitate an airtight connection (e.g., seal, contact) between the adjoining panels 220. Further, in some embodiments, the second side 224 may include the flange 250 and the first side 222 of an adjoining panel 220 may include the cavity 252 configured to receive the flange 250 and/or engage with the flange 250 from the second side 224 of the adjoining panel 220.

Figure 7D:
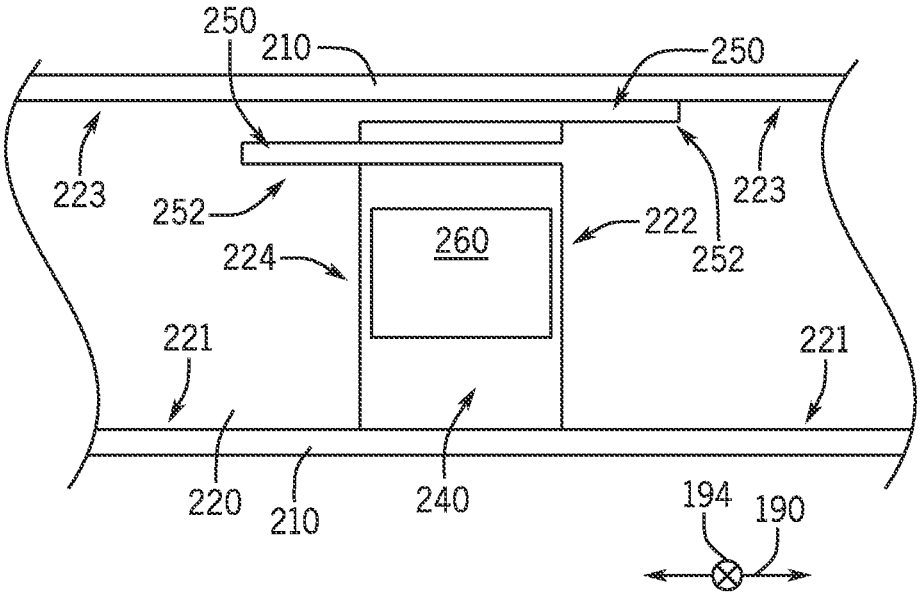
FIG. 7D is an enhanced, cross-sectional, top-view of an embodiment of the partition wall, in accordance with an aspect of the present disclosure.

Turning to FIG. 7D, in some embodiments, a flange 250 may extend from both the first side 222 and the second side 224 of each panel 220 and each flange 250 may be substantially coplanar with the second surface 223 of the panel 220. Accordingly, the flange 250 extending from the second side 224 of a panel 220 may abut and/or overlap a flange 250 extending from the first side 222 of an adjoining panel 220, thereby forming an airtight connection between adjoining panels 220 without using fasteners and/or screws. In some embodiments, the flanges 250 of adjoining panels 220 may partially overlap (e.g., less than 50% overlap) with each other, while in other embodiments, the flanges 250 of adjoining panels 220 may substantially overlap (e.g., greater than 50% overlap) with each other. Further, both the first side 222 and the second side 224 may each include a cavity 252 configured to receive the flange 250 extending from the adjoining panel 220, which may facilitate the airtight connection between adjacent panels 220. Further, a channel 240 may be formed between adjacent panels 220, and may extend along the height of the panel 220 in a direction along the vertical axis 194. Each channel 240 may be defined by a second side 224 of a panel 220, a first flange 250 extending from the second side 224 of the panel 220, a second flange 250 extending from the first side 222 of an adjoining panel 220 and the first side 222 of the adjoining panel 220. Further, the stiffener 260 may be provided within the channel 240 to provide reinforcement to the partition wall 200, and the channel 240 may circumscribe the stiffener 260 from three sides.

Figure 7E:
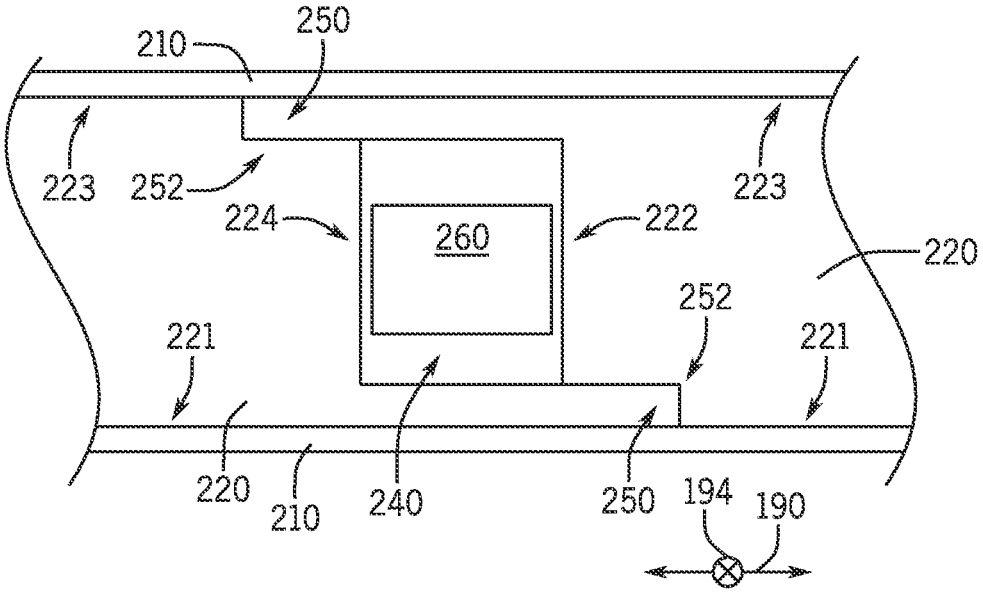
FIG. 7E is an enhanced, cross-sectional, top-view of an embodiment of the partition wall, in accordance with an aspect of the present disclosure.

FIG. 7E is a cross-sectional, enhanced, top-view of another embodiment of the partition wall 200, in accordance with an aspect of the present disclosure. As illustrated, in some embodiments, a flange 250 may extend from both the first side 222 and the second side of each panel 220. However, the flange 250 extending from the first side 222 of a panel 220 may be a flange that is substantially coplanar with the second surface 223 of the panel 220, and the flange 250 extending from the second side 224 of a panel 220 may be a flange that is substantially coplanar with the first surface 221 of the panel 220. The flanges 250 may be configured to engage with the first and second sides 222, 224 of an adjoining panels 220 to form an airtight connection between adjoining panels 220 without using screws or fasteners (e.g., mechanical securement). In some embodiments, the first and second sides 222, 224 of each panel 220 may include a cavity 252 configured to receive the flanges 250 to facilitate the airtight connection between the adjacent panels 220. Thus, a channel 240 may be formed between adjacent panels 220, and may extend along the height of the panel 220 (e.g., distance 234 of FIG. 6) in a direction along the vertical axis 194. Each channel 240 may be defined by a second side 224 of a panel 220, a flange 250 extending from the second side 224 and coplanar with a first surface 221 of the panel 220, a first side 222 of an adjoining panel 220, and a flange 250 extending from the first side 222 and coplanar with a second surface 223 of the adjoining panel 220. Further, the stiffener 260 may be provided within the channel 240 to provide reinforcement to the partition wall 200, and the channel may circumscribe the stiffener 260 from all four sides.

Figure 7F:
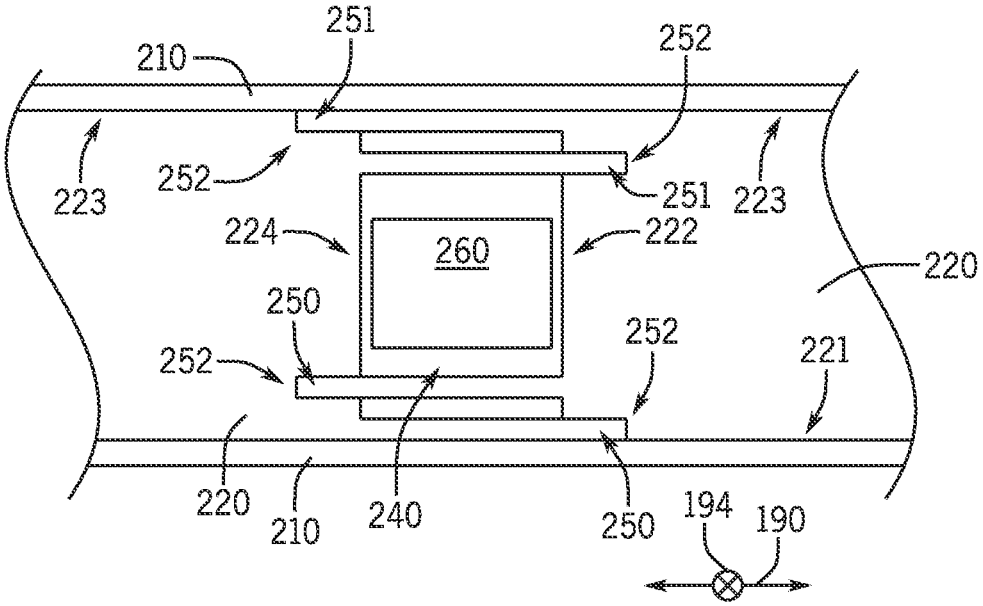
FIG. 7F is an enhanced, cross-sectional, top-view of an embodiment of the partition wall, in accordance with an aspect of the present disclosure.

FIG. 7F is a cross-sectional, enhanced, top-view of another embodiment of the partition wall 200. In some embodiments, two or more flanges 250 may extend from each of the first side 222 and the second side 224 respectively. A first flange 250 may be substantially coplanar with the first surface 221 of the panel 220, while a second flange 251 may be substantially coplanar with a second surface 223 of the panel 220. Each of the first and second flanges 250, 251 extending from the second side 224 of a panel 220 may abut, partially overlap, or substantially overlap a first and second flange 250, 251 extending from the first side 222 of an adjoining panel 220, thereby enabling an airtight connection between adjacent panels 220. Further, each of the first sides 222 and the second sides 224 of each panel 220 may include one or more channels 252 configured to receive the first and second flanges 250, 251, respectively, thereby facilitating the airtight connection between the adjacent panels 220 without using fasteners and/or screws. Similar to the embodiment depicted in FIG. 7C, a channel 240 may be formed between the adjacent panels 220, and may extend along the height of the panel 220 (e.g., distance 234 of FIG. 6) in a direction along the vertical axis 194. Each channel 240 may be defined by a second side 224 of a panel 220, a first flange 250 extending from the second side 224 and coplanar with a first surface 221 of the panel 220, a second flange 251 extending from the second side 224 and coplanar with the second surface 223 of the panel 220, a first side 222 of an adjoining panel 220, a first flange 250 extending from the first side 222 and coplanar with the first surface 221 of the adjoining panel 220, and a second flange 251 extending from the first side 222 and coplanar with the second surface 223 of the adjoining panel 220. Further, the stiffener 260 may be provided within the channel 240 to provide reinforcement to the partition wall 200, and the channel 240 may circumscribe the stiffener 260 from all four sides.

It should be noted that the arrangement, number, and orientation of the flanges 250, 251 along the sides 222, 224 of the respective panels 220 should not be limited to the examples listed above. That is, in some embodiments, each of the panels 220 may have as many flanges 250 and/or cavities 252 as needed to enable an airtight connection between adjoining panels 220 without using fasteners and/or screws. For example, the partition wall 200 may include one or more panels 220 having zero, one, two, or more flanges 250 extending from a first side 222, zero, one, two, or more flanges 250 extending from a second side 224, or one, two, or more flanges 250 extending from both the first side 222 and the second side 224 of a panel 220. Further, it should be noted that the first support member 204 and/or the second support member 206 may be configured to receive the one or more flanges 250 extending from the first side 222 and/or the second side 224, as described in greater detail below.

Further, in accordance with the present disclosure, the stiffener 260 illustrated in FIGS. 7A-7F may include a solid profile that can be one of, but not limited to, circular shaped, semi-circular shaped, square shaped, rectangular shaped, torus shaped, and the like. In some embodiments, the stiffener 260 has a shape and/or contour that conforms to the shape of the channel 240. That is, the stiffener 260 may be a singular, unitary piece of material that is configured to fit within the channel 240 and/or be at least partially circumscribed by the channel 240. In other embodiments, the stiffener 260 may include multiple portions or segments that are disposed within the channel 240. In some embodiments, the stiffener may not completely cover the channel 240, and a sealant may be utilized to fill and seal the channel 240, thereby supplementing or facilitating the airtight connection between adjoining panels 220.

Figure 8A:
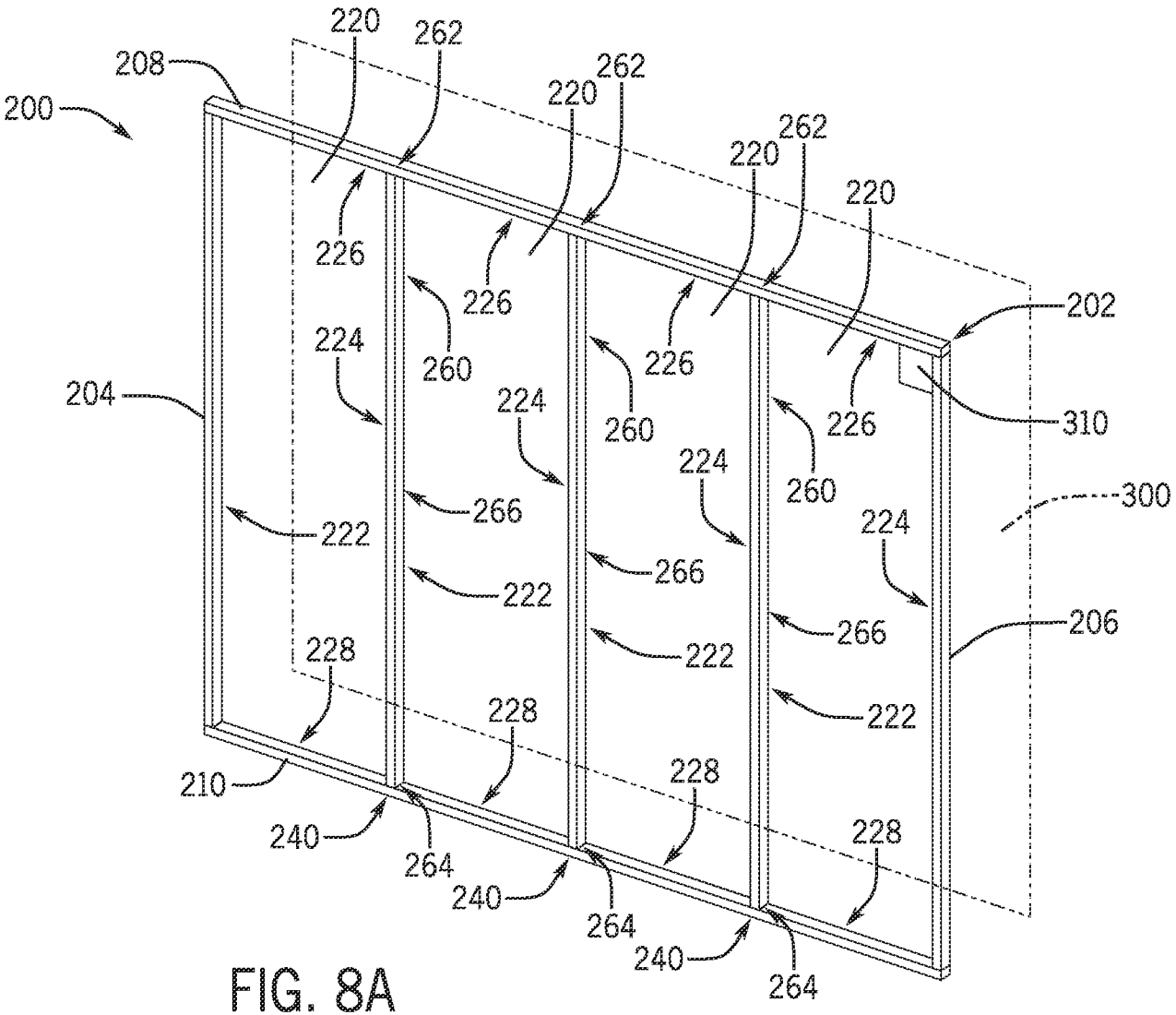
FIG. 8A is a front perspective view of an embodiment of the partition wall, in accordance with an aspect of the present disclosure.

FIG. 8A is a front perspective view of an embodiment of the partition wall 200 with one or more stiffeners 260 disposed between adjoining panels 220, in accordance with an aspect of the present disclosure. The stiffeners 260 may include a head portion 262, a sill portion 264, and an intermediate portion 266. The head portion 262 may be configured to engage with the first cross rail 208, and the sill portion 264 may be configured to engage with the second cross rail 210 of the frame 202. In an operative configuration, the third side 226 of the panels 220 and the head portion 262 of the stiffeners 260 may be alternatively engaged with the first cross rail 208, and the fourth side 228 of the panels 220 and the sill portion 264 of the stiffeners 260 may be alternatively engaged with the second cross rail 210. The stiffeners 260 may be configured to engage and/or abut with the sides 222, 224 of the panels 220 and the flanges 250 of the panels 220 to facilitate the airtight connection (e.g., seal, contact) between adjoining panels 220, thereby limiting use of fasteners and screws in the partition wall 200 and allowing for toolless engagement of the panels 220. Additionally, one or more insulation layers 300 may be provided on one of the sides of the partition wall 200 to facilitate the separation of various compartments within the HVAC unit. Further, in some embodiments, the partition wall 200 may include one or more openings 310 positioned within one or more of the panels 220 to facilitate electrical and/or fluid connection with an adjacent compartment of an HVAC device, such as the packaged HVAC unit 100 of FIG. 5.

Figure 8B:
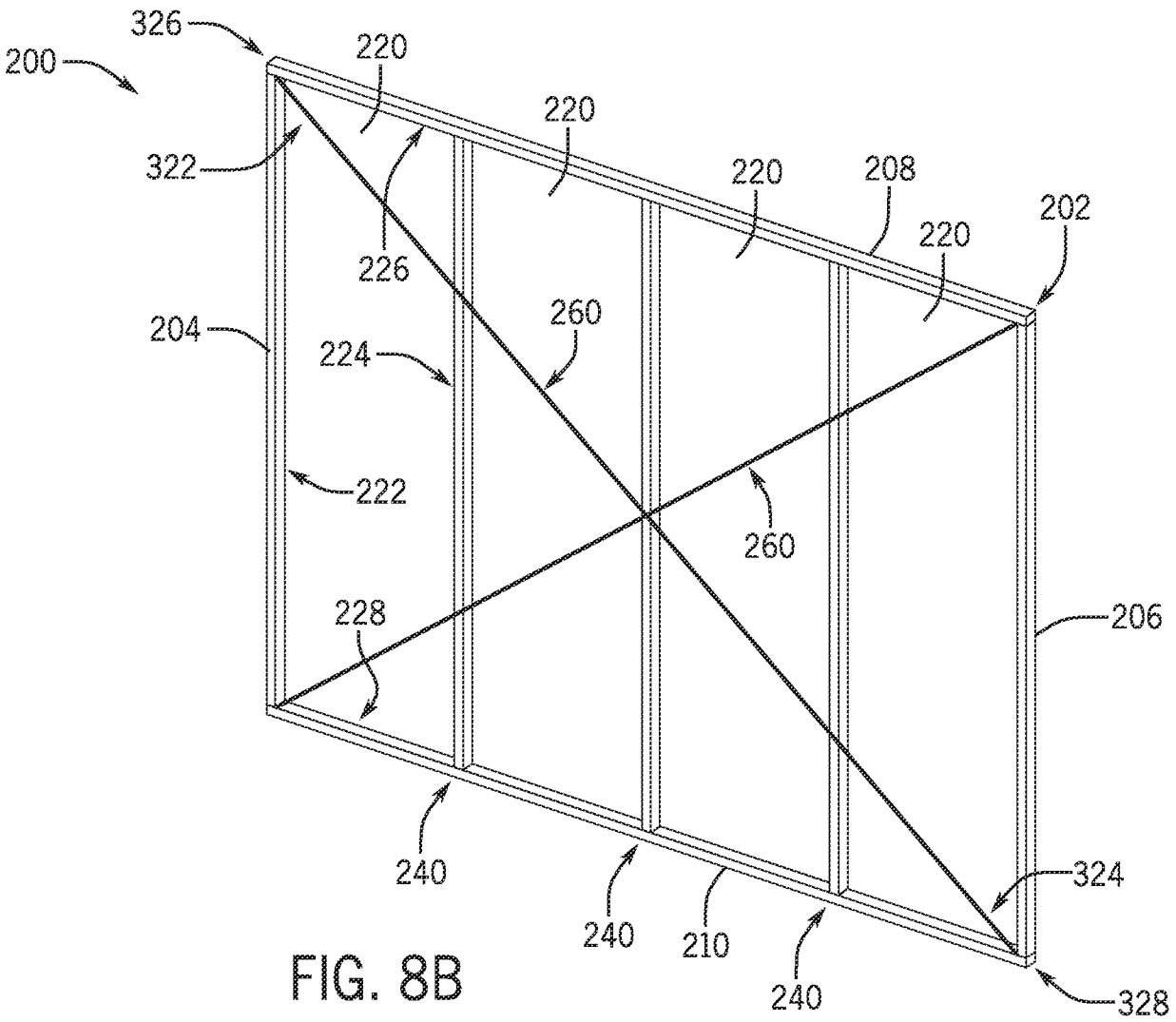
FIG. 8B is a front view of an embodiment of the partition wall, in accordance with an aspect of the present disclosure.

FIG. 8B is a front perspective view of an embodiment of the partition wall 200 with one or more stiffeners 260, in accordance with an aspect of the present disclosure. As illustrated, the partition wall 200 may extend as defined by the frame 202, and may include two or more panels 220 with channels 240 extending between adjacent panels 220. Further, the one or more stiffeners 260 may extend diagonally across the partition wall 200. For example, a stiffener 260 may extend across the partition from a first end 322 to a second end 324. The first end 322 may extend from a position 326 (e.g., corner) between the first support member 204 and the first cross rail 208, and the second end 324 may extend from a position 328 (e.g., corner) between the second support member 206 and the second support rail 210. The stiffeners 260 may be configured to provide support for the partition wall 200.

Figure 8C:
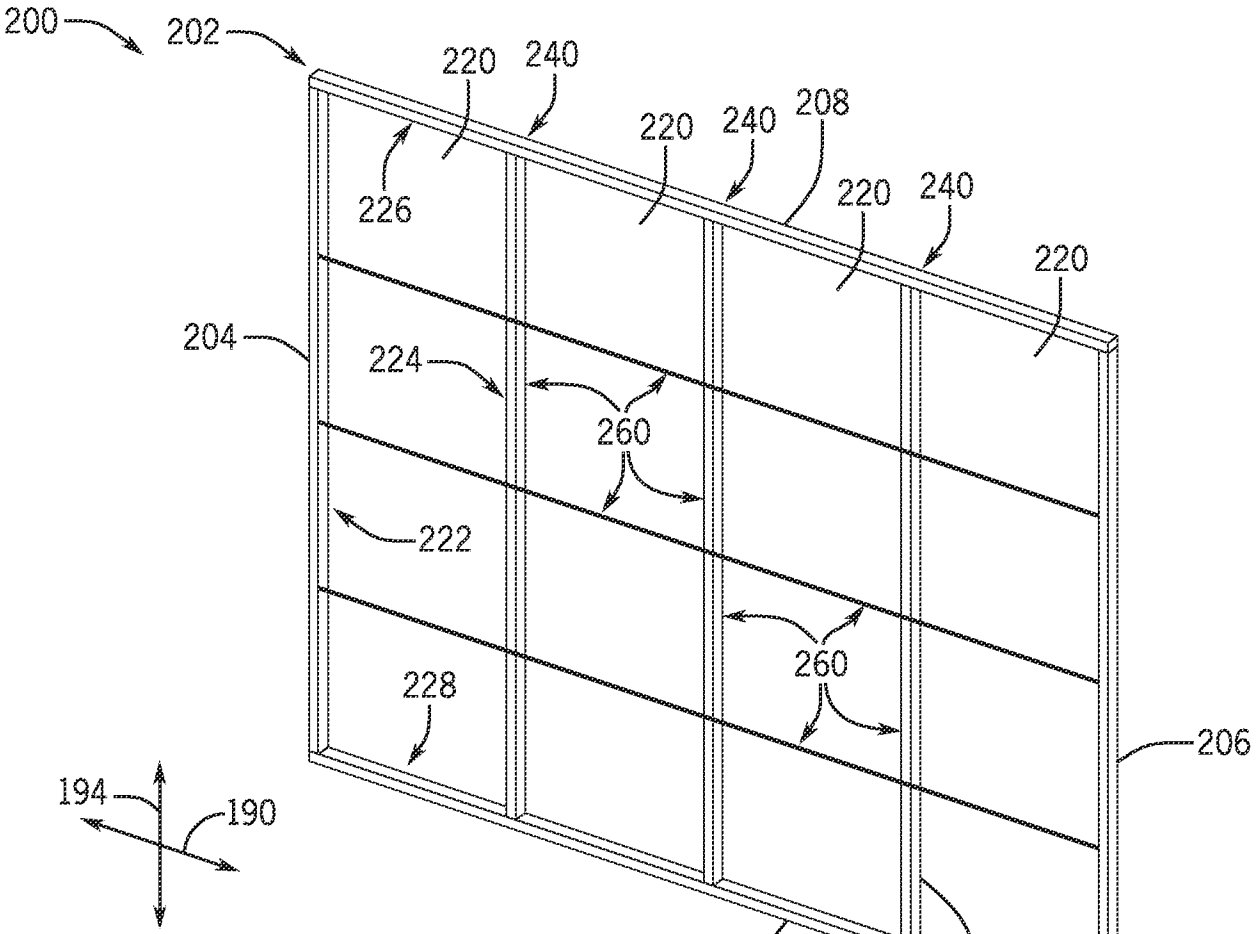
FIG. 8C is a front perspective view of an embodiment of the partition wall, in accordance with an aspect of the present disclosure.

FIG. 8C is a front perspective view of an embodiment of the partition wall 200 with one or more stiffeners 260, in accordance with an aspect of the present disclosure. As illustrated, the partition wall 200 may extend within the frame 202, and may include two or more panels 220 with channels 240 extending between adjacent panels 220. Further, one or more stiffeners 260 may extend between the first support member 2044 and the second support member 206 in a direction along a horizontal axis 190, and one or more stiffeners 260 may extend between the first cross rail 208 and the second cross rail 210 in a direction along the vertical axis 194.

It should be noted that the arrangement, orientation, and/or number of stiffeners 260 should not be limited to the examples listed above. Indeed, in some embodiments, the partition wall 200 may include any combination of the above-listed stiffeners 260 to provide support for the frame 202 and the partition wall 200 while limiting the use of fasteners, screws, and other mechanical securements.

Figure 9A:
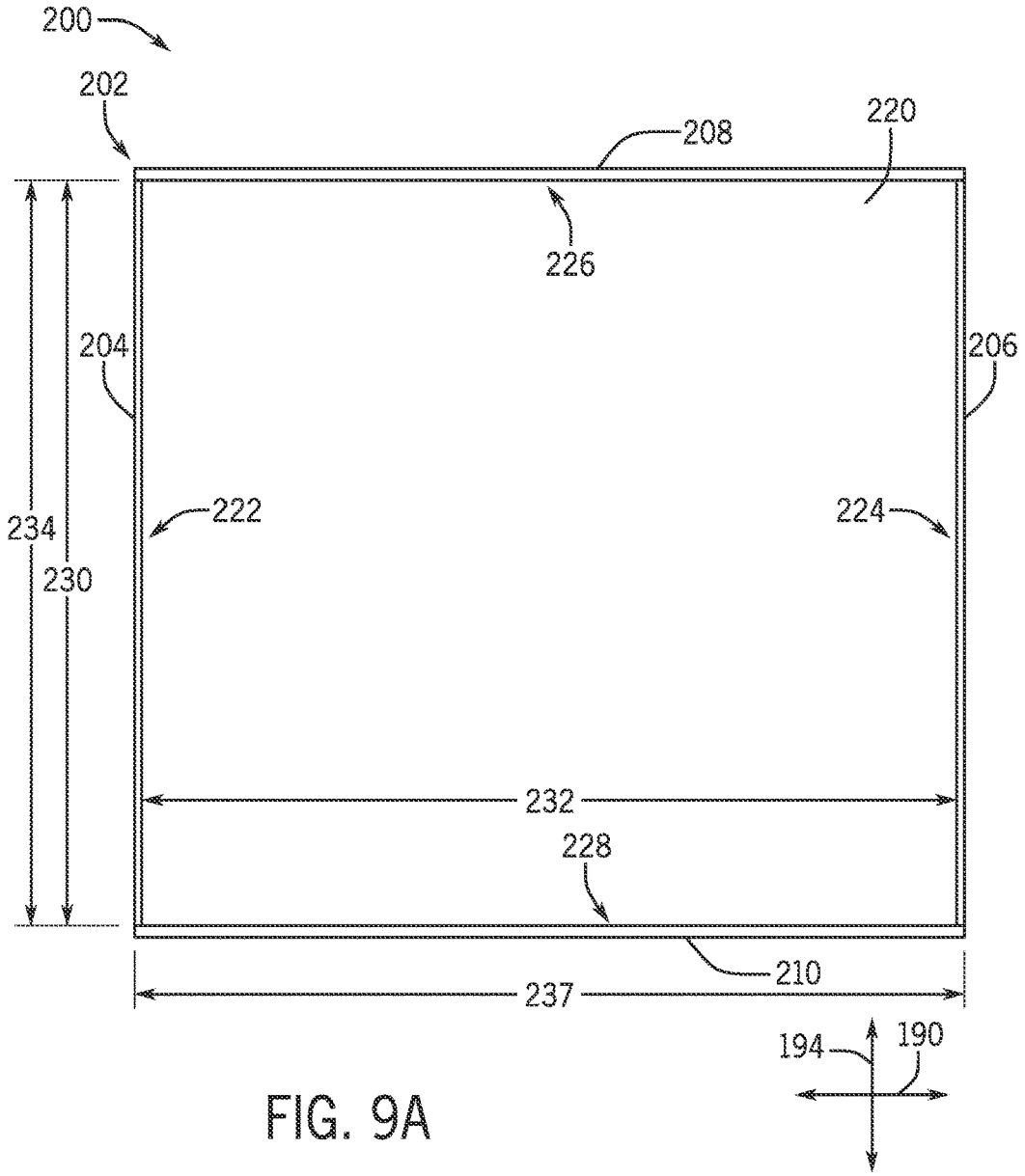
FIG. 9A is a front view of an embodiment of the partition wall, in accordance with an aspect of the present disclosure.

FIG. 9A is a front view of an embodiment of the partition wall 200, in accordance with an aspect of the present disclosure. In some embodiments, the partition wall 200 may be defined by a single panel 220 disposed within the frame 202 between the first support member 204, the second support member 206, the first cross rail 208, and the second cross rail 210. That is, the first and second sides 222, 224 of the single panel 220 may extend for a distance 234 (e.g., height) in a direction along the vertical axis 194, and the third and fourth sides 226, 228 may extend for a distance 237 (e.g., length) in a direction along the horizontal axis 190. The height 234 of the single panel 220 may be equal to the height 230 of the frame 202, and the length 237 of the single panel 220 may be equal to the length 232 of the frame 202, thereby enabling the panel 220 to extend across the frame 202.

Figure 9B:
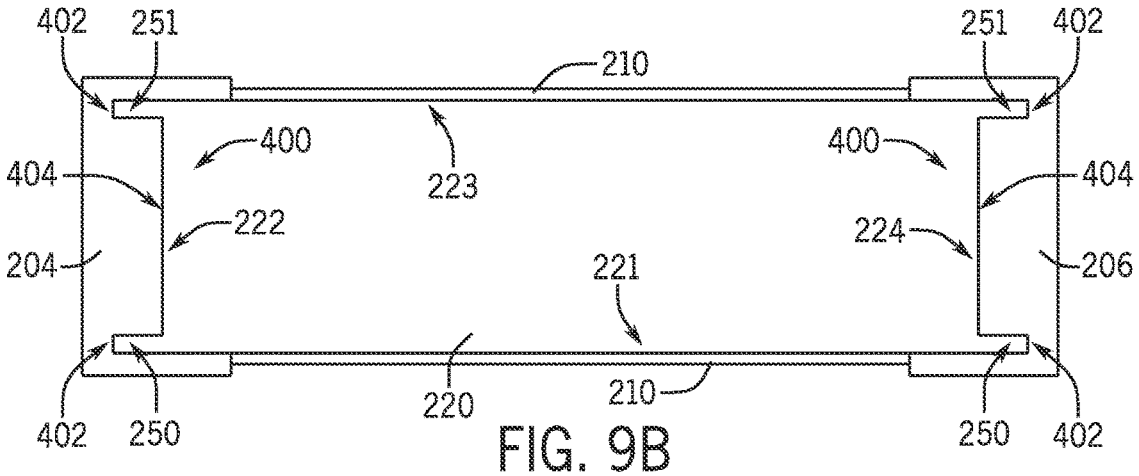
FIG. 9B is a top cross-sectional view of an embodiment of the partition wall, in accordance with an aspect of the present disclosure.

FIG. 9B is a top view of an embodiment of the partition wall 200, in accordance with an aspect of the present disclosure. As discussed above, one or more flanges 250 may extend from the first side 222 and/or the second side 224 of the panel 220, and may abut and/or engage with the first support member 204 and the second support member 206. That is, the first support member 204 and the second support member 206 may each have a port 400 configured to receive the first side 222 or the second side 224 of the panel 220. For example, the first support member 204 may include the port 400 configured to receive the first side 222 of the panel 220. The second support member 206 may include the port 400 configured to receive the second side of the panel 220. Further, each of the ports 400 of the first support member 204 and the second support member 206 may be provided with one or more receptacles 402 configured to receive the one or more flanges 250, 251 extending from the first side 222 or the second side 224 of the panel 220. Each of the first support member 204 and the second support member 206 may be take on a shape corresponding to a profile defined by the first side 222, the second side 224, and the flanges 250, 251 of the panel 220. That is, the surface 404, and/or the receptacles 402 of the port 400 may be correspond to the shape of the first side 222 or the second side 224 having one or more flanges 250, 251, and a position of the receptacles 250 may be adjusted based on a position of the one or more flanges 250, 251. For example, for a panel 220 having two flanges 250, 251 extending from the first side 222, the first support member 206 may include the port 400 having a surface 404 configured to abut the first side 222 of the panel 220 and may also include two corresponding receptacles 402 within the port 400 configured to receive the two flanges 250, 251. By providing the flanges 250, 251, the ports 400, the surface 404, and/or the receptacles 402 as disclosed herein, an airtight connection between the first support member 204 and the first side 222 of the panel 220, and between the second support member 206 and the second side 224 of the panel 220 is provided without the use of mechanical securements (e.g., screws, fasteners).

Figure 9C:
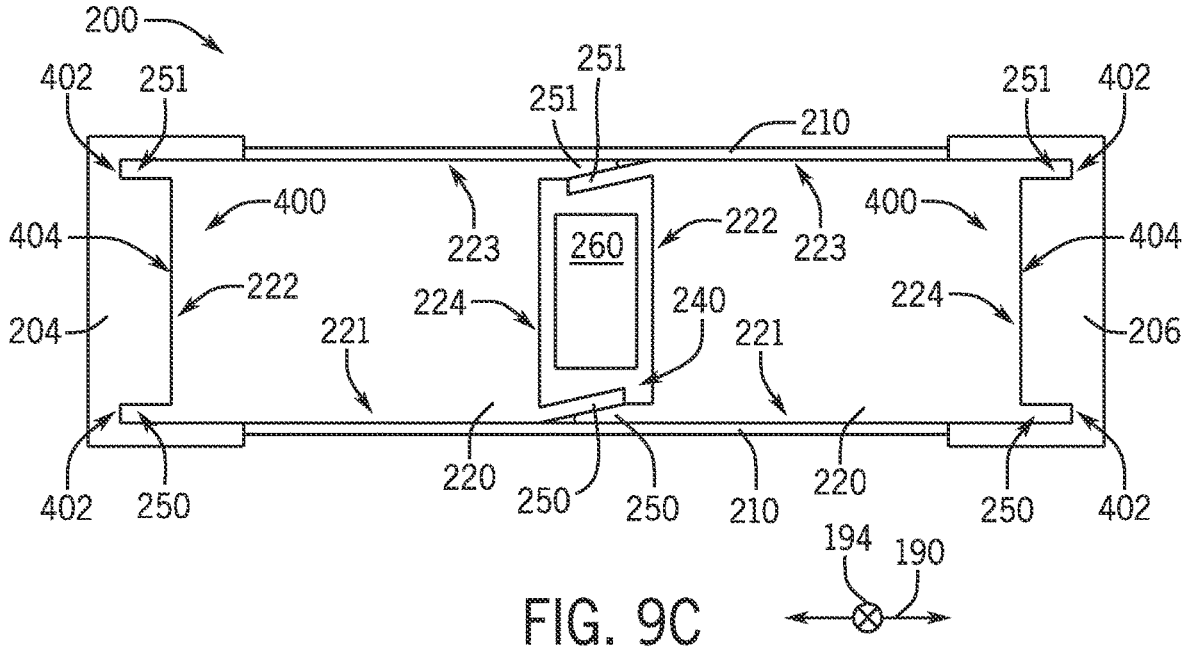
FIG. 9C is a top cross-sectional view of an embodiment of the partition wall, in accordance with an aspect of the present disclosure.

FIG. 9C is a top view of an embodiment of the partition wall 200, in accordance with an aspect of the present disclosure. As illustrated, each of the panels 220 may include a first flange 250 and a second flange 251 extending from both the first surface 222 and the second surface 224. As discussed above, each of the first support member 204 and the second support member 206 may include a port 400 having one or more receptacles 402 configured to receive the first flange 250 and the second flange 251 extending from the first side 222 or the second side 224 of the panel 220. Further, similar to the discussion above with respect to FIG. 7B, the first flange 250 extending from the first side 222 of a respective panel 220 may be configured to engage with (e.g., abut, overlap) the first flange 250 extending from the second side 224 of an adjoining panel 220, and the second flange 251 extending from the first side 222 of the respective panel 220 may be configured to engage with the second flange 251 extending from the second side 224 of the adjoining panel 220 to form an airtight contact there between. That is, each of the flanges 250, 251 from both the first and second sides 222, 224 of adjoining panels 220 may flex to engage with and/or overlap with one another to facilitate the air-tight engagement.

Figure 9D:
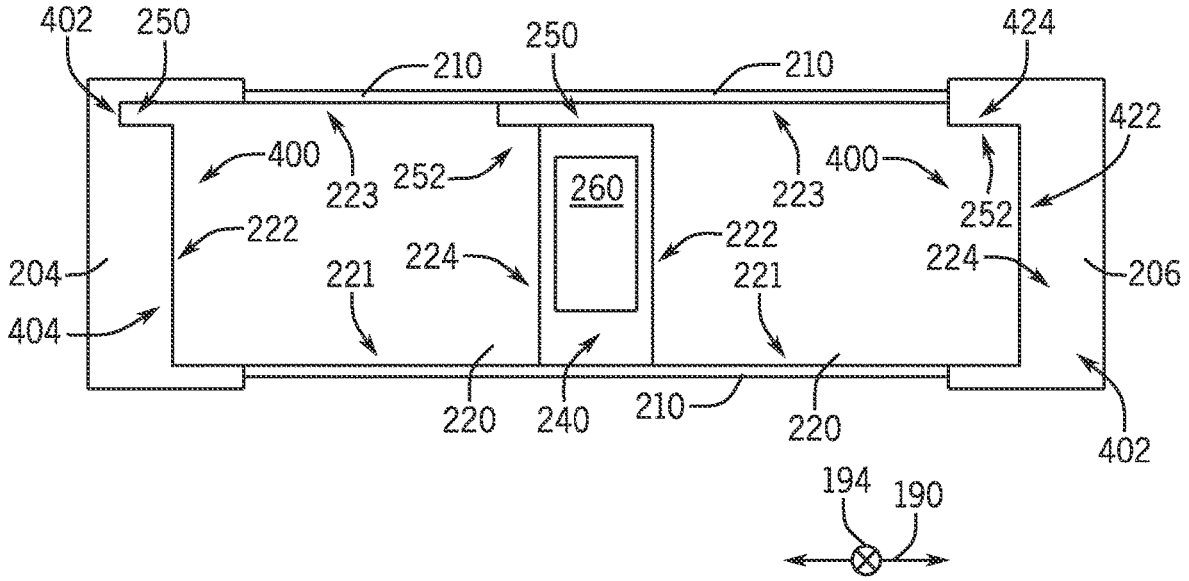
FIG. 9D is a top cross-sectional view of an embodiment of the partition wall, in accordance with an aspect of the present disclosure.

FIG. 9D is a top view of an embodiment of the partition wall 200, in accordance with an aspect of the present disclosure. As noted above, each of the first support member 204 and the second support member 206 may take on a shape defined by a profile of the one or more panels 220. For example, each of the panels 220 may include a flange 250 extending from the first side 222 of a panel 220 and coplanar with a second surface 223 of the panel 220. Further, the second side 224 of each of the panels 220 may include a cavity 252 configured to receive and engage with the flange 250 extending from the first side 222 of an adjoining panel 220. Accordingly, the first support member 204 may take on a shape corresponding to the first side 222 of a panel 220, and the second support member 206 may take on a different shape corresponding to the second side 224 of a panel 220. For example, the first support member 204 may include a port 400 configured to receive the first side 222 of a panel 220 and the port 400 may include a receptacle 402 coplanar with the second surface 223 of the panels 220 and configured to receive the flange 250 extending from the first side of the panel 220. The port 400 may also include a surface 404 configured to abut the first side 222 of the panel 220. The second support member 206 may include a port 420 configured to receive the second side 224 of a panel 220 and the port 420 may include a surface 422 configured to abut the second side 224 of the panel 220. However, the port 420 may not include a receptacle (e.g., such as the receptacle 402 of port 400) because the second side 224 of each panel 220 does not include a flange 250. Instead, the second support member 206 may include an extension 424 coplanar with the second surface 223 of the panels 220 configured to engage with the cavity 252 disposed along the second side 224 of each panel 220. That is, the cavity 252 on the second side 224 of the panel 220 may be configured to receive the flange 250 from the first side 222 of an adjoining panel or the extension 424 from the second support member 206. It should be noted that the example above is not intended to be limiting and each of the panels 220, the first support member 204, and the second support member 206 may include any number of shapes, arrangements, and orientations without departing from the scope of the present application.

Figure 10:
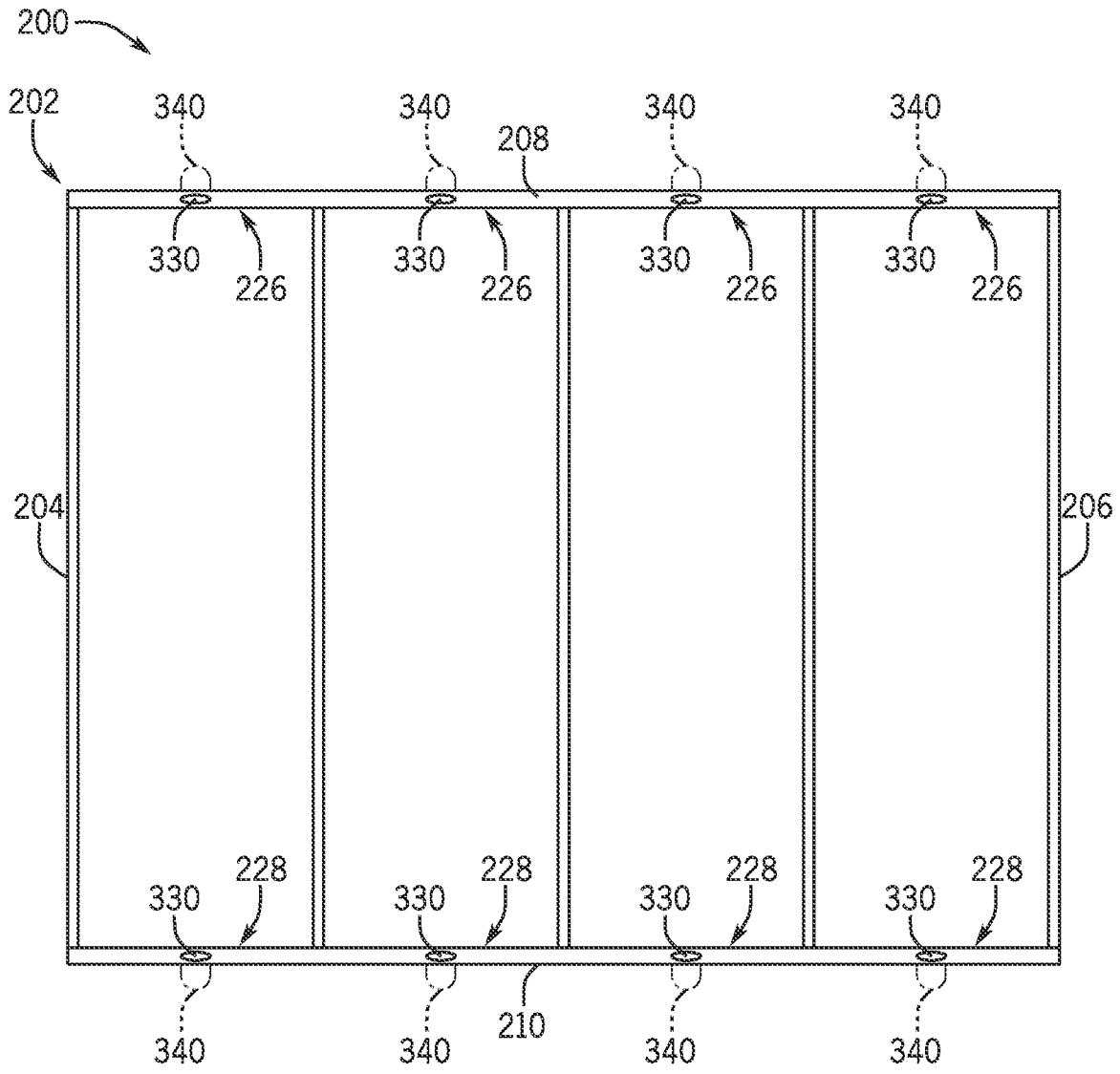
FIG. 10 is a front view of an embodiment of the partition wall, in accordance with an aspect of the present disclosure.

FIG. 10 is a front view of an embodiment of the partition wall 200, in accordance with an aspect of the present disclosure. As shown in the illustrated embodiment, one or more holes 330 may be disposed within one or both the first cross rail 208 and the second cross rail 210. The one or more holes 330 may be configured to receive one or more projections 340 (e.g., spring plungers) extending from the third side 226 and/or the fourth side 228 of the panels 220, thereby facilitating the engagement between the panel 220 and the first and second cross rails 208, 210 of the frame 202. That is, a position of the panel may be locked while the projection 340 is engaged with one of the holes 330 provided along the first cross rail 208 and/or the second cross rail 210.

As set forth above, the partition (e.g., partition wall, panel) of the present disclosure may provide one or more technical benefits useful in the construction, assembly, maintenance, and/or operation of HVAC systems, such as packaged HVAC units. For example, the one or more partitions may be disposed within a housing of an HVAC unit and may be slidably coupled to a frame of the housing. The partition may include one or more panels, and adjoining panels may engage with one another via flanges extending from a first side and/or a second side of the panels and cavities disposed within the first and second sides of the panels and configured to receive the flanges. Further, one or more channels may be defined by the sides of the panels and the flanges and one or more stiffeners may be used to provide support to the frame and/or the adjoining panels. By providing the partitions with one or more flanges, cavities, channels, and stiffeners, an airtight connection may be achieved between adjoining panels and/or between the sides of the panel and components of the frame, while a number of mechanical securements (e.g., fasteners, screws, pins) may be limited during the construction of the HVAC unit. As a result, production costs may be decreased and assembly times may be reduced, thereby resulting in increased efficiency. Further, the presently disclosed techniques may reduce a likelihood of wear and degradation to the HVAC system and its components. The technical effects and technical problems in the specification are examples and are not limiting. It should be noted that the embodiments described in the specification may have other technical effects and can solve other technical problems.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for (perform)ing (a function) . . . " or "step for (perform)ing (a function) . . . ", it is intended that such elements are to be interpreted under 35 U.S.C. 112(f). However, for any claims containing elements designated in any other manner, it is intended that such elements are not to be interpreted under 35 U.S.C. 112(f).

While only certain features and embodiments of the disclosure have been illustrated and described, many modifications and changes may occur to those skilled in the art, such as variations in sizes, dimensions, structures, shapes and proportions of the various elements, values of parameters, including temperatures and pressures, mounting arrangements, use of materials, colors, orientations, and so forth without materially departing from the novel teachings and advantages of the subject matter recited in the claims. The order or sequence of any process or method steps may be varied or re-sequenced according to alternative embodiments. It is, therefore, to be understood that the appended claims are intended to cover all such modifications and changes as fall within the true spirit of the disclosure. Furthermore, in an effort to provide a concise description of the exemplary embodiments, all features of an actual implementation may not have been described, such as those unrelated to the presently contemplated best mode of carrying out the disclosure, or those unrelated to enabling the claimed disclosure. It should be noted that in the development of any such actual implementation, as in any engineering or design project, numerous implementation specific decisions may be made. Such a development effort might be complex and time consuming, but would nevertheless be a routine undertaking of design, fabrication, and manufacture for those of ordinary skill having the benefit of this disclosure, without undue experimentation.

The invention claimed is:

1. A partition wall for a heating, ventilation, and air conditioning (HVAC) unit, comprising:

a frame defining a perimeter of the partition wall; and one or more panels extending within the frame, wherein each respective panel of the one or more panels comprises a flange coplanar with a corresponding first surface of the respective panel relative to a plane extending along a height of the respective panel, wherein the flange is configured to slidably abut an additional first surface of an adjacent panel of the one or more panels or the frame along the plane such that the flange is captured between the additional first surface and the frame to provide substantially air-tight engagement there between.

2. The partition wall of claim 1, wherein the frame comprises a first support member and a second support member extending in a first direction, and a first cross rail and a second cross rail extending in a second direction orthogonal to the first direction.

3. The partition wall of claim 1, wherein each of the one or more panels is slidably coupled to the frame.

4. The partition wall of claim 1, wherein each of the one or more panels is snap-fitted to the frame.

5. The partition wall of claim 1, wherein each of the one or more panels comprises a first side and a second side, and wherein the flange comprises one or more flanges extending from the first side, the second side, or both.

6. The partition wall of claim 5, wherein each of the first side and the second side of each panel includes one or more cavities configured to receive a respective one or more flanges from another of the one or more panels.

7. The partition wall of claim 5, wherein a channel is defined by the first side of a first panel of the one or more panels, the second side of a second panel of the one or more panels adjacent to the first panel, and the one or more flanges extending from the first side or the second side of the first panel or the second panel.

8. The partition wall of claim 7, wherein a stiffener is disposed within the channel between each of the one or more panels.

9. The partition wall of claim 8, wherein each stiffener is circumscribed on three sides by:

the second side of the first panel of the one or more panels;

the first side of the second panel of the one or more panels adjacent to the first panel; and the flange.

10. A heating, ventilation, and air conditioning (HVAC) unit, comprising:

a housing configured to provide support for one or more components of the HVAC unit; and one or more partition walls extending within or around the housing and configured to separate the housing into two or more internal volumes, wherein a partition wall of the one or more partition walls comprises:

a frame coupled to the housing and defining a perimeter of the partition wall, wherein the frame comprises a first support member, a second support member, a first cross rail, and a second cross rail; and one or more panels extending within the frame, wherein each respective panel of the one or more panels comprises a flange coplanar with a corresponding first surface of the respective panel relative to a plane extending along a height of the respective panel, wherein the flange comprises a first surface configured to abut an additional first surface of an adjacent panel of the one or more panels along the plane and a second surface opposite the first surface and configured to abut the frame along the plane to provide substantially air-tight engagement there between.

11. The HVAC unit of claim 10, wherein each panel of the one or more panels is slidably coupled to the first cross rail, the second cross rail, or both.

12. The HVAC unit of claim 10, wherein each panel of the one or more panels is snap-fitted to the first cross rail, the second cross rail, or both.

13. The HVAC unit of claim 10, wherein at least one of the one or more panels is coupled to an insulation layer.

14. The HVAC unit of claim 10, wherein each of the one or more panels comprises a first side and a second side, wherein the first side and the second side of each panel includes one or more cavities configured to receive one or more flanges, and wherein the one or more flanges extending from a first panel of the one or more panels engages with the one or more cavities of a second panel of the one or more panels adjacent to the first panel to provide an additional substantially air-tight engagement there between.

15. The HVAC unit of claim 10, wherein each of the first support member and the second support member comprises:

a port having a surface configured to abut a first side or a second side of the one or more panels; and one or more receptacles configured to receive one or more flanges extending from the first side or the second side of the one or more panels.

16. A housing configured to enclose one or more components of a heating, ventilation, and air conditioning (HVAC) system, comprising:

a base; and one or more frames coupled to the base and configured to define a perimeter of one or more partition walls extending within the housing, wherein the one or more partition walls are configured to separate the housing into two or more internal volumes, and wherein each of the one or more partition walls comprises:

one or more panels extending within a frame of the one or more frames, wherein each respective panel of the one or more panels comprises one or more flanges coplanar with a corresponding first surface of the respective panel relative to a plane extending along a height of the respective panel, wherein a first flange of the one or more flanges is configured to slidably engage an additional first surface of an adjacent panel of the one or more panels and the frame along the plane such that the first flange is captured between the additional first surface and the frame to provide substantially air-tight engagement there between.

17. The housing of claim 16, wherein each of the one or more panels comprises:

a first side and a second side each configured to abut another of the one or more panels or the frame, wherein the first side of each panel comprises:

the first flange of the one or more flanges extending in a first direction coplanar with the corresponding first surface of the one or more panels;

a second flange of the one or more flanges extending in the first direction and positioned closer to a stiffener relative to the first flange;

a first cavity configured to engage with an additional first flange from another of the one or more panels; and a second cavity configured to engage with an additional second flange from another of the one or more panels.

18. The housing of claim 16, wherein each frame of the one or more frames comprises a first support member, a second support member, a first cross rail, and a second cross rail, wherein each of the one or more panels is configured to engage with the first support member and the second support member to provide the air-tight engagement there between, and wherein each of the one or more panels is configured to slidably couple to the first cross rail, the second cross rail, or both.

19. The housing of claim 18, wherein each of the first support member and the second support member comprises a port having a surface configured to abut a side of the one or more panels, and wherein the port comprises one or more receptacles configured to receive and engage with the one or more flanges from the one or more panels.

20. The partition wall of claim 8, wherein the flange is a first flange, and wherein each respective panel comprises a second flange positioned closer to the stiffener relative to the first flange.

* * * * *